US011744771B2

(12) United States Patent
Beard et al.

(10) Patent No.: US 11,744,771 B2
(45) Date of Patent: Sep. 5, 2023

(54) CARDIOPULMONARY RESUSCITATION DEVICE, CONTROL, METHOD AND COMPUTER PROGRAM

(71) Applicant: KONINKLIJKE PHILIPS N.V., Eindhoven (NL)

(72) Inventors: Timothy Beard, Cambridge, MA (US); Christopher John Wright, London (GB); David Duffy, Cambridge, MA (US)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 17/608,897

(22) PCT Filed: Apr. 27, 2020

(86) PCT No.: PCT/EP2020/061571
§ 371 (c)(1),
(2) Date: Nov. 4, 2021

(87) PCT Pub. No.: WO2020/224998
PCT Pub. Date: Nov. 12, 2020

(65) Prior Publication Data

US 2022/0265510 A1 Aug. 25, 2022

(30) Foreign Application Priority Data

May 6, 2019 (EP) ..... 19172788

(51) Int. Cl.
*A61H 31/00* (2006.01)

(52) U.S. Cl.
CPC ... *A61H 31/007* (2013.01); *A61H 2201/5007* (2013.01); *A61H 2201/5061* (2013.01);
(Continued)

(58) Field of Classification Search
CPC ..... A61H 31/00; A61H 31/007; A61H 2201/5007; A61H 2201/5061;
(Continued)

(56) References Cited

U.S. PATENT DOCUMENTS 4,809,683 A * 3/1989 Hanson ..... A61H 31/007 601/41
5,645,522 A * 7/1997 Lurie ..... A61H 31/00 607/142
(Continued)

FOREIGN PATENT DOCUMENTS

WO 2018083634 A1 5/2018

OTHER PUBLICATIONS

Indian Patent Application No. 1174/CHE/2012, filed Mar. 28, 2012.
(Continued)

*Primary Examiner* — Timothy A Stanis

(57) ABSTRACT

According to an aspect, there is provided a cardiopulmonary resuscitation, CPR, device (1) for enhancing the delivery of CPR to a patient. The device (1) comprises: a patient side (3) for engagement with the chest of the patient; and a user side (2) for engagement with the hands of a user delivering CPR to the patient. One or more of the surface of the patient side (3) and the surface of the user side (2) is at least partially formed of a material with variable contact characteristics configured to be controlled so as to regulate the lateral force distribution profile at the one or more of the surface of the patient side (3) and the surface of the user side (2) from a force applied to the device (1) by the user and transferred through the device (1) to the patient. According to other aspects, there is provided a control method for a cardiopulmonary resuscitation, CPR, device and a computer program
(Continued)

which, when executed on a computing device, carries out a control method for a cardiopulmonary resuscitation, CPR, device.

15 Claims, 3 Drawing Sheets

(52) U.S. Cl.
CPC ..... *A61H 2201/5071* (2013.01); *A61H 2201/5092* (2013.01); *A61H 2230/065* (2013.01)

(58) Field of Classification Search
CPC .... A61H 2201/5071; A61H 2201/5092; A61H 2230/065; A61H 2230/255; A61H 2230/305
See application file for complete search history.

(56) References Cited

U.S. PATENT DOCUMENTS

2006/0084892 A1 4/2006 Jung
2007/0088233 A1* 4/2007 Wood ..... A61H 31/004 601/44
2010/0198118 A1 8/2010 Itnati
2011/0201979 A1* 8/2011 Voss ..... A61H 31/004 601/41
2011/0313322 A1 12/2011 Fossan
2013/0030326 A1* 1/2013 Bogdanowicz ..... A61B 5/11 600/587
2013/0066242 A1* 3/2013 Wood ..... A61H 31/007 601/41
2013/0324894 A1* 12/2013 Herken ..... A61H 31/006 601/41
2015/0265497 A1 9/2015 Freeman
2015/0335522 A1 11/2015 Okada
2016/0317385 A1 11/2016 Menegazzi
2017/0000688 A1 1/2017 Freeman
2017/0049413 A1 2/2017 Adedipe
2017/0181925 A1* 6/2017 Oppenheimer ..... A61H 31/007
2018/0092804 A1 4/2018 Desmarais
2018/0261128 A1 9/2018 Freeman
2020/0000680 A1* 1/2020 Silver ..... A61H 31/00

OTHER PUBLICATIONS

International Search Report for PCT/EP2020/061571 dated Apr. 27, 2020.

* cited by examiner

CARDIOPULMONARY RESUSCITATION DEVICE, CONTROL, METHOD AND COMPUTER PROGRAM

This application is a national stage application under 35 U.S.C. § 371 of International Application No. PCT/EP2020/061571 filed on Apr. 27, 2020 and published in the English language on Nov. 12, 2020 as International Publication No. WO2020/224998, which claims priority to European Patent Application No. 19172788.2 filed on May 6, 2019, the entire disclosures of which are incorporated herein by reference.

TECHNICAL FIELD OF THE INVENTION

Embodiments of the present invention relate generally to cardiopulmonary resuscitation (CPR) and to a device, a control method for the device and a corresponding computer program for enhancing the delivery of CPR to a patient.

BACKGROUND OF THE INVENTION

The general background of this invention is in cardiopulmonary resuscitation (CPR) devices to assist with the delivery of CPR to a patient. CPR involves a user (rescuer) applying chest compressions to a patient so as to manually pump oxygenated blood to the brain. The effectiveness of chest compressions delivered during CPR can vary depending on a number of factors. For example, the optimal location for application of compression force varies between individual patients. The force required to provide the appropriate compression may also vary.

CPR devices may be used to aid the user with the delivery of CPR to the patient and thus increase the effectiveness of the CPR to the patient. Such devices may be provided for use between the hands of the user providing CPR and the patient receiving CPR. The transfer of force from the user to the patient may be dependent on a number of factors including the properties of a CPR device being used and the force applied.

Poor delivery of CPR can cause significant damage to a cardiac arrest victim, and damage can occur even from the first compression. Similarly, if the depth of the compressions is too shallow then, although safer in that damage is less likely to occur, blood flow will be poor, which may result in lower patient outcomes, such as, for example, neurological conditions. It is therefore important that the chest compressions applied during the delivery of CPR have appropriate depths and thus that appropriate force is transferred from the user to the patient.

It is desirable to enhance the delivery of CPR to the user so that the CPR is more effective and the benefit of the CPR to the patient is increased. It is also desirable to minimize the risk of damage to the patient and/or user during the delivery of CPR.

SUMMARY OF THE INVENTION

According to embodiments of aspects of the present invention, a CPR device may be provided with one or more variable properties, such that the transfer of force from the user to the patient may be altered by the one or more variable properties of the device. Embodiments of aspects of the invention also extend to method aspects corresponding to the device aspects and to a computer program aspect which, when executed on a computing device, carries out a method.

According to an embodiment of an aspect, there is provided a cardiopulmonary resuscitation, CPR, device for enhancing the delivery of CPR to a patient, the device comprising: a patient side for engagement with the chest of the patient; and a user side for engagement with the hands of a user delivering CPR to the patient, wherein one or more of the patient side and the user side is at least partially formed of a non-Newtonian fluid, the viscosity of which is configured to vary in response to the application of energy so as to regulate a force distribution profile of the device from a force applied to the device by the user and transferred through the device to the patient.

Thus, according to embodiments of this aspect of the present invention, the device is at least partially formed of a non-Newtonian fluid (NNF), i.e. a fluid that does not have a constant viscosity independent of stress. The viscosity of the NNF therefore varies in response to energy applied to the NNF. The energy may be a force, a stress and/or a stimulus. For example, the energy may be a force applied to the device at the user side by the user during the delivery of chest compressions for CPR and the viscosity of the NNF may vary as the force applied to the device varies.

It may be seen that the variable viscosity of the NNF, which forms at least part of the CPR device, results in a force distribution profile of the device that may vary as energy is applied to the NNF and the viscosity of the NNF varies. The force distribution profile may be considered as the distribution of force by the device and, if the device is positioned on the chest of the patient, the distribution of force to the patient at the patient side, in particular, the chest of the patient. It will be appreciated that if the patient side is at least partially formed of the NNF, then the force from the device to the chest of the patient will vary as the viscosity of the NNF varies and the rigidity of the patient side varies. Similarly, if the user side is at least partially formed of the NNF, then the force absorbed by or transferred through the device from a force applied at the user side will vary as the viscosity of the NNF varies and the force from the device to the chest of the patient will therefore also vary. The force distribution profile of the device may therefore be regulated by the varying viscosity of the NNF.

By regulating the force distribution profile, the effectiveness of the CPR delivery may be controlled and maximized. That is, the effectiveness of chest compressions applied to the patient during delivery of CPR may be regulated such that they have the greatest positive impact on the patient and/or user, and/or minimize damage to the patient and/or user. This is due to the variable viscosity of the NNF allowing the device to appropriately adapt and control the force transferred to the patient. The NNF with variable viscosity may therefore regulate the patient's hemodynamic activity when a force is applied to the user side of the puck and transferred to the patient, such as, for example, as a chest compression during the delivery of CPR to the patient. That is, the patient's hemodynamic activity may be improved by the regulation of the force distribution profile of the device by the NNF.

Depending on the position of the NNF in the device, the device may conform to the chest of the patient when it is positioned on the chest of the patient and/or it may conform to the shape of the hands of the user. For example, if the patient side is (at least partially) formed of the NNF, then the patient side may (at least partially) conform to the shape of the chest of the patient when the viscosity of the NNF is low. Similarly, if the user side is (at least partially) formed of the NNF, then the user side may (at least partially) conform to the shape of the hands of the user when the user contacts the device and the viscosity of the NNF is low. The contact between the device and the patient and/or the user may therefore be increased. Each of the patient side and the user side may be at least partially formed of a non-Newtonian fluid.

As energy is applied to the NNF, for example, as the user presses down on the device to deliver chest compressions to the patient during CPR, the viscosity of the NNF may vary. For example, the viscosity may increase such that the rigidity of at least part of the device increases and the transfer of energy through the device is increased. That is, the viscosity of the NNF may increase so that the device becomes firmer and a larger amount of force is transferred through the device to the patient. Alternatively, the viscosity of the NNF may decrease as force is applied to the device. The response to the energy by the NNF may be dependent on the type of NNF.

Considering the example in which the viscosity of the NNF increases as the force increases, when little or no force is applied to the device, the device may (at least partially) conform to the shape of the patient's chest and/or the user's hands because the viscosity of the NNF is low and the resulting rigidity of the device is also low. As a force applied to the device increases, the viscosity of the NNF increases and the device (at least partially) becomes more rigid. More force may therefore be transferred through the device to the patient than if the viscosity had remained low and the resulting compressions on the chest of the patient are likely to be deeper than if the rigidity of the device had remained low. The NNF may therefore allow the device to be both conformable and rigid at different stages of the CPR delivery. The CPR device at least partially formed of an NNF may therefore achieve a balance of conformability and rigidity which may be difficult to achieve otherwise, and the device may improve the comfort of use of the device whilst also having sufficient compression efficiency.

The CPR device may comprise a controller configured to control the viscosity of the non-Newtonian fluid by applying energy to the non-Newtonian fluid so as to provide a target force distribution profile to the patient from a force applied to the device by the user. That is, the viscosity may be controlled by the controller independently of the force applied to the device by the user so that the force distribution profile of the device may be regulated by the controller to achieve, or approach, a target force distribution profile. Thus it may be seen that the device may have a passive state in which the viscosity of the NNF is varied only in response to a pressure applied by the user and an active state in which the NNF is also varied in response to energy applied by the controller. The controller may be referred to as a processor.

The controller may control the variable viscosity of the NNF so as to provide a force distribution profile of the device corresponding to a target force distribution profile which may achieve, or may be more likely to achieve, a desired hemodynamic activity in the patient. The controller may determine the target force distribution profile and then apply energy to the NNF so that the force distribution profile of the device matches, or at least moves towards matching, the determined target force distribution profile. Thus, one or more of the patient side and the user side may be at least partially formed of a non-Newtonian fluid with variable viscosity configured to be dynamically controlled by the controller.

The device may comprise a force sensor configured to acquire force data of a force applied to the device and the controller may be configured to determine the target force distribution profile in accordance with the force data. Force sensor data may therefore be acquired and analyzed to determine the target force distribution profile, such that the controller may be configured to control the viscosity of the non-Newtonian fluid in accordance with a measurement of the force applied to the device.

The force sensor may measure, as force sensor data, forces applied to the CPR device, such as, for example, forces applied to the device by the user during the delivery of CPR chest compressions. The force sensor may be configured to measure one or more of: a lateral force, a longitudinal force and a perpendicular (normal) force. The force sensor may continuously measure forces applied to the device over a given period, at a certain point in time, or at a plurality of time points over a given period. The force sensor may acquire the force sensor data and provide it to the controller. All or only some of the force sensor data may be provided to the controller. For example, the force sensor data may only be provided to the controller if the measured force exceeds a predetermined threshold and/or if the measured force changes by a predetermined amount.

The force sensor may be provided as part of the CPR device or may be provided as part of a system comprising the device. A plurality of force sensors may be utilized, and each force sensor may measure a different type or the same type of force as another force sensor. The force sensor may be considered as a pressure sensor. The controller may be configured to periodically re-determine the target force distribution profile using the most recently acquired force sensor data. The controller may therefore dynamically control the viscosity of the NNF fluid on the basis of force applied to the device so as to maximize the effectiveness of the chest compressions delivered to the patient and/or to minimize damage to the patient and/or user based on the more recent data. For example, the force sensor may measure the force applied to the device during a chest compression and the controller may vary the viscosity of the NNF so that a subsequent chest compression, which is likely to be similar in force, will have the greatest positive impact on the patient. For example, if the measured force is determined by the controller to be relatively low, then the controller may apply energy to the NNF that increases the viscosity so that the rigidity of the device is increased and more force is transferred to the patient. Conversely, if the measured force is determined by the controller to be relatively high, then the controller may apply energy to the NNF that decreases the viscosity so that the rigidity of the device is decreased and less force is transferred to the patient so as to minimize the risk of injury to the patient and/or user.

The device may be communicably coupled with a patient sensor configured to collect patient sensor data relating to the condition of the patient. The device may be configured to receive the patient sensor data from the patient sensor. The controller may be configured to determine the target force distribution profile in accordance with the patient sensor data. Patient sensor data may therefore be acquired and analyzed to determine the target force distribution profile, such that the controller may be configured to control the viscosity of the non-Newtonian fluid on the basis of the data indicating the condition of the patient. The patient sensor data may be considered as being representative of, indicative of, and/or related to the condition of the patient.

The patient sensor may measure, as patient sensor data, a parameter or sign of the patient that indicates a condition of the patient. For example, the patient sensor may acquire sensor data indicative of one or more of the following parameters of the patient: heart rate; blood pressure; skin condition, such as hydration, oiliness and elasticity; coronary perfusion pressure (CPP); delivery of blood to the brain; delivery of injected therapeutics around the body;

detection and analysis of internal or external bleeding; detection of subcutaneous soft tissue and bone damage; and hemodynamic behavior. Thus the hemodynamic activity of the patient may be a condition of the patient to be monitored by a patient sensor.

The patient sensor may comprise standard ultrasound imaging or UWB (ultra-wideband) radar to image and determine heart muscle and adjacent vasculature activity. The patient sensor may comprise ultrasound imaging to measure blood pressure of the patient. Additionally or alternatively, the patient sensor may comprise one or more pressure sensors to determine bone damage, such as, for example, to the ribs which may be detected via changes to the pressure profile on the CPR device. The patient sensor may measure hemodynamic behavior and predict the delivery of injected therapeutics around the circulatory system from the behavior. The patient sensor may comprise a capacitance measurement to determine hydration of the skin of the patient, an optical sensor to determine the oiliness and redness of the skin of the patient, and/or a vibrational sensor to determine elasticity of the skin of the patient. The patient sensor may comprise a camera configured to capture images of the patient and the controller may be configured to determine a condition of the patient by analyzing the captured images. The camera may capture an individual frame or a plurality of frames in sequence.

The patient sensor may continuously measure patient parameters or signs over a given period, at a certain point in time, or at a plurality of time points over a given period. The patient sensor may acquire the patient sensor data and provide it to the controller. All or only some of the patient sensor data may be provided to the controller. For example, the patient sensor data may only be provided to the controller if the measured parameter or sign exceeds a predetermined threshold and/or if the measured parameter or sign changes by a predetermined amount.

The controller may be configured to periodically redetermine the target force distribution profile using the most recently acquired patient sensor data. The controller may therefore dynamically control the viscosity of the NNF fluid on the basis of the condition of the patient so as to deliver a force distribution profile which will be most beneficial to the patient, based on the patient's current state.

The patient sensor may be provided as part of the CPR device or may be provided as part of a system comprising the device. A plurality of patient sensors may be utilized, with each patient sensor measuring a parameter or sign of the patient which is different from or the same as another patient sensor.

The device may be communicably coupled with a user sensor configured to collect user sensor data relating to the condition of the user. The device may be configured to receive the user sensor data from the user sensor. The controller may be configured to determine the target force distribution profile in accordance with the user sensor data. User sensor data may therefore be acquired and analyzed to determine the target force distribution profile, such that the controller may be configured to control the viscosity of the non-Newtonian fluid on the basis of the data indicating the condition of the user. The user sensor data may be considered as being representative of, indicative of, and/or related to the condition of the user.

The user sensor may measure, as user sensor data, a parameter or sign of the user that indicates a condition of the user. For example, the user sensor may acquire sensor data indicative of one or more of the following parameters of the user: heart rate; blood pressure; skin condition; body movements; emotional state; breathing rate; body geometry; and body position.

The user sensor may comprise wearable sensors worn by the user and used to determine body movements, geometry and/or positioning. The user sensor may comprise a smart device with sensors to determine heart arrhythmias and/or blood pressure. The user sensor may comprise a camera to capture an image of the user and determine a state of the user. For example, the state may be determined by analyzing the breathing rate and/or discomfort in facial expressions in acquired images. The camera may capture an individual frame or a plurality of frames in sequence. The user sensor may comprise a capacitance measurement to determine hydration of the skin of the user, an optical sensor to determine the oiliness and redness of the skin of the user, and/or a vibrational sensor to determine elasticity of the skin of the user. The user sensor may comprise pressure or optical sensors positioned on the user side of the device to determine the heart rate of the user when the user's hands contact the user side. The user sensor may comprise a microphone configured to capture audio data of the user and the controller may be configured to analyze the captured audio data to determine a condition of the user. The user sensor may comprise a heart rate sensor configured to measure the heart rate of the user.

The user sensor may continuously measure user parameters or signs over a given period, at a certain point in time, or at a plurality of time points over a given period. The user sensor may acquire the user sensor data and provide it to the controller. All or only some of the user sensor data may be provided to the controller. For example, the user sensor data may only be provided to the controller if the measured parameter or sign exceeds a predetermined threshold and/or if the measured parameter or sign changes by a predetermined amount.

The controller may be configured to periodically redetermine the target force distribution profile using the most recently acquired user sensor data. The controller may therefore dynamically control the viscosity of the NNF fluid on the basis of the condition of the user so as to deliver a force distribution profile which will be most beneficial to the patient and/or the user, based on the user's current state.

The user sensor may be provided as part of the CPR device or may be provided as part of a system comprising the device. A plurality of user sensors may be utilized, with each user sensor measuring a parameter or sign of the user which is different from or the same as another user sensor.

The device may be communicably coupled with a memory configured to store information on the patient. The device may be configured to acquire information on the patient from the memory. The controller may be configured to determine the target force distribution profile in accordance with the information on the patient.

The information on the patient may comprise one or more of: the age of the patient; the health of the patient; a vital sign of the patient; a medical diagnosis of the patient; and historical patient data relating to past delivery of CPR to the patient. Information on the patient may therefore be acquired and analyzed to determine the target force distribution profile, such that the controller may be configured to control the viscosity of the non-Newtonian fluid on the basis of the information on the patient.

The memory may be provided as part of the CPR device or may be provided as part of a system comprising the device. A plurality of memories may be utilized, with each memory storing information on the patient which is different from or the same as the information stored in another memory.

The device may be communicably coupled with a memory configured to store information on the user. The device may be configured to acquire information on the user from the memory. The controller may be configured to determine the target force distribution profile in accordance with the information on the user.

The information on the user may comprise one or more of: the age of the user; the identity of the user; the health of the user; a vital sign of the user; a medical diagnosis of the user; historical user data relating to past delivery of CPR; body dimensions of the user; weight of the user; age of the user; medical qualifications of the user; medical training of the user; and a fitness level of the user. Information on the user may therefore be acquired and analyzed to determine the target force distribution profile, such that the controller may be configured to control the viscosity of the non-Newtonian fluid on the basis of the information on the user.

The memory may be provided as part of the CPR device or may be provided as part of a system comprising the device. A plurality of memories may be utilized, with each memory storing information on the user which is different from or the same as the information stored in another memory. Furthermore, information on the patient may be stored in the same memory or a different memory as information on the user.

The one or more of the patient side and the user side formed of the non-Newtonian fluid may be segregated into a plurality of fluid sections. The controller may be configured to control the viscosity of the non-Newtonian fluid of a fluid section of the plurality of fluid sections independently of one or more of the other fluid sections of the plurality of fluid sections. The device may therefore comprise multiple sections or cells each containing NNF which may be controlled independently of the NNF in other sections or cells. Thus, the fluid sections may provide pixelated control across the one or more of the patient side and the user side formed of the NNF. The compression force at each section may be individually controlled and the controller may determine the target force distribution profile in accordance with the plurality of fluid sections.

The non-Newtonian fluid may be one of: a shear thickening fluid; a shear thinning fluid; and a rheopectic fluid. The type of fluid or the shear thickening dynamics of the fluid may be designed and optimized for the range of forces present during CPR.

Although the specific force required for optimal compression depth of the chest may differ among patients due to inter-individual differences, ranges have been identified for different groups (such as, for example, adults, children, infants, males, females etc.). For example, the forces required for males and females may be in the ranges 320 N±80 N and 270 N±70 N, respectively. Thus the type of NNF may be determined based on the patient group that the device is intended to be used with and the desired forces for the patient group.

The one or more of the patient side and the user side formed of the non-Newtonian fluid may be segregated into a plurality of fluid sections; and the non-Newtonian of a fluid section of the plurality of fluid sections may be different to the non-Newtonian fluid of one or more of the other fluid sections of the plurality of fluid sections.

The energy applied by the controller may be one or more of: an electrical field applied to the non-Newtonian fluid; an ultrasonic wave applied to the non-Newtonian fluid; a magnetic field applied to the non-Newtonian fluid; and vibrations applied to the non-Newtonian fluid. Thus the viscosity of the NNF may be controlled using one or more of the above stimuli. The type of stimuli to be used may be determined by the properties of the NNF and/or the application of the CPR device. For example, an ultrasonic transducer may be used to modulate the stiffness of the NNF independently of the force applied to the device by the user. The device may comprise a plurality of fluid sections and the energy used to control the NNF in one fluid section may be the same as or different to the energy used to control the NNF in another fluid section. One or more of the fluid sections may each be provided with an ultrasonic transducer.

Shear thickening fluids (STFs) are non-Newtonian fluids whose properties vary based on the application of a shear force. They may be soft and conformable at low levels of force, but stiffen and behave more like a solid when a higher level of force is applied. The formulation of STFs may be adjusted to tune the properties of the fluid, including viscosity, critical shear rate, storage modulus, and/or loss modulus. The properties of STFs may be changed dynamically using, for example, electrical fields, magnetic fields and/or vibrations.

A rheopectic fluid is a non-Newtonian fluid in which the viscosity increases over time as more shear force is applied. This may, for example, allow the device to adapt to the user and patient over time and retain that customized shape even when force is removed. The viscosity of the non-Newtonian fluid may be configured to vary over time such that the viscosity of the non-Newtonian fluid at a first time point is different to the viscosity of the non-Newtonian fluid at a second time point occurring after the first time point.

A shear thinning fluid is a non-Newtonian fluid in which the viscosity of the fluid decreases under shear strain. This may, for example, reduce the risk of over compression since the viscosity of the fluid and thus the rigidity of the device may decrease when a force likely to lead to over compression is applied.

The device may comprise an actuator and the controller may be configured to operate the actuator so as to apply a force to the non-Newtonian fluid and control the viscosity of the non-Newtonian fluid. The actuator may be a soft actuator. The actuator may be activated and deactivated by the controller so that it expands and compresses to apply pressure and release pressure against the NNF. The device may comprise a plurality of actuators which may be independently controlled to apply different pressure to the NNF at different locations. The one or more of the patient side and the user side formed of the non-Newtonian fluid may be segregated into a plurality of fluid sections and an actuator may be provided in each of one or more of the fluid sections.

The device may comprise an accelerometer configured to acquire acceleration data by measuring acceleration of the device at a plurality of time points. The controller may be configured to: determine, from the acceleration data, a distance the device moves when a force is applied to the device; and control the viscosity of the non-Newtonian fluid in accordance with the distance. Thus, the acceleration may be measured and analyzed to determine the distance that the device moves when force is applied and thus to determine the depth of the chest compressions. The target force distribution profile may then be determined such that the controller may be configured to control the viscosity of the non-Newtonian fluid in accordance with a determined compression depth of a chest compression applied during CPR delivery and a target compression depth.

The controller may be configured to periodically re-determine the target force distribution profile using the most recently acquired acceleration data and thus the most recently determined compression depth. The controller may therefore dynamically control the viscosity of the NNF fluid on the basis of the compression depth as to maximize the effectiveness of the subsequent chest compressions delivered to the patient, based on more recent data.

During CPR and the application of force to the patient's chest by the user, a compression cycle starts with no force being applied to the chest, continues with increasing application of force until a maximum compression depth is reached, and then as the force is released, returns to the starting point. The compression cycle may therefore be determined from the acceleration data. For example, the time taken to perform a compression cycle may be determined by observing the change in acceleration over time. That is, the increase and change in the acceleration may be used to determine when the compression cycle starts, when the maximum compression depth is reached and when the compression cycle ends. The compression depth may be determined, for example, by double integration of accelerometer data to determine the distance travelled between the top position and bottom position of a compression cycle and thus the maximum compression depth.

The accelerometer may continuously measure the acceleration of the device over a given period, at a certain point in time, or at a plurality of time points over a given period. The accelerometer may acquire the acceleration data and provide it to the controller. All or only some of the acceleration data may be provided to the controller. For example, the acceleration data may only be provided to the controller if the measured acceleration exceeds a predetermined threshold and/or if the measured acceleration changes by a predetermined amount.

The device may be communicably coupled with a camera configured to acquire image data of the device positioned on the chest of the patient. The device may be configured to receive the image data from the camera. The controller may be configured to determine the position of the device relative to the chest of the patient using the image data and to determine the target force distribution profile in accordance with the position of the device relative to the chest of the patient. Image data may therefore be acquired and analyzed to determine the target force distribution profile, such that the controller may be configured to control the viscosity of the non-Newtonian fluid in accordance with image data from which the position of the device on the chest of the patient may be identified.

The camera may continuously capture, as image data, images over a given period, at a certain point in time, or at a plurality of time points over a given period. The camera may capture an individual frame or a plurality of frames in sequence. The camera may acquire the image data and provide it to the controller. All or only some of the image data may be provided to the controller. The controller may acquire the image data and may perform image processing to identify the device, the patient and the position of the device relative to the chest of the patient. The target force distribution profile may at least partially be determined by the position of the device. For example, certain positions on the chest of the patient may require more force to be transferred through the device to the patient and certain positions may require less force.

The camera may be provided as part of the CPR device or may be provided as part of a system comprising the device. A plurality of cameras may be utilized each configured to acquire image data from a different angle.

The controller may be configured to periodically re-determine the target force distribution profile using the most recently acquired image data. The controller may therefore dynamically control the viscosity of the NNF fluid on the basis of the identified position of the device relative to the chest of the patient so as to maximize the effectiveness of the chest compressions delivered to the patient based on the device's more recent position. For example, the controller may determine the position of the device during a chest compression and the controller may vary the viscosity of the NNF so that a subsequent chest compression will have the greatest positive impact on the patient at the determined location. For example, if the device is determined to be positioned on the chest of the patient at a location with stronger bones, then the controller may apply energy to the NNF that increases the viscosity so that the rigidity of the device is increased and more force is transferred to the patient. Conversely, if the device is determined to be positioned on a location of the chest of the patient that is weaker, then the controller may apply energy to the NNF that decreases the viscosity so that the rigidity of the device is decreased and less force is transferred to the patient so as to minimize the risk of injury to the patient.

The device may comprise a plurality of pressure sensors disposed on the patient side of the device and each pressure sensor may be configured to acquire pressure sensor data of pressure applied to the device. The controller may be configured to determine the position of the device relative to the chest of the patient using the acquired pressure sensor data and to determine the target force distribution profile in accordance with the position of the device relative to the chest of the patient. Pressure sensor data may therefore be acquired and analyzed to determine the target force distribution profile, such that the controller may be configured to control the viscosity of the non-Newtonian fluid in accordance with a measurement of the pressure on the device.

The pressure sensors may measure, as pressure sensor data, the pressure at the patient side of the CPR device. The pressure sensors may continuously measure the pressure at the patient side over a given period, at a certain point in time, or at a plurality of time points over a given period. Not all of the pressure sensors may be active at the same time and the pressure sensors may be split into one or more groups with each group measuring the pressure at different points in time or at different parts of the compression cycle. The pressure sensors may acquire the pressure sensor data and provide it to the controller. All or only some of the pressure sensor data may be provided to the controller. For example, the pressure sensor data may only be provided to the controller if the measured pressure exceeds a predetermined threshold and/or if the measured pressure changes by a predetermined amount.

The controller may acquire the pressure sensor data and may perform analysis of the pressure sensor data to identify the position of the device relative to the chest of the patient. For example, higher pressure readings on the sensors may indicate that the device is positioned on bony structures such as the solar plexus and ribs, whereas lower pressure readings may indicate a position on soft tissue such as the gaps between the ribs and the edge of the diaphragm. The target force distribution profile may at least partially be determined by the position of the device. For example, certain positions on the chest of the patient may require more force to be transferred through the device to the patient and certain positions may require less force.

The one or more of the patient side and the user side formed of the non-Newtonian fluid may be segregated into a plurality of fluid sections. One or more of the plurality of fluid sections may each be provided with a pressure sensor. The controller may be configured to control the viscosity of the non-Newtonian fluid of a fluid section of the plurality of fluid sections on the basis of the pressure measured at that fluid section and independently of one or more of the other fluid sections of the plurality of fluid sections.

The controller may be configured to determine a target position of the device relative to the chest of the patient. The controller may be configured to compare the target position with the position of the device to determine a difference between the target position and the position of the device. The controller may be configured to determine the target force distribution profile in accordance with the difference so as to minimize the difference. That is, a target force distribution may be determined which moves or is likely to move the device to the target position when force is applied to the device.

The device may comprise a plurality of pressure sensors disposed on the patient side of the device and each may be configured to acquire pressure sensor data of pressure applied to the device. The controller may be configured to monitor the pressure sensor data at a plurality of time points. The controller may determine a change in pressure sensor data at a second time point of the plurality of time points, which is later than a first time point of the plurality of time points. The controller may be configured to determine the target force distribution profile in accordance with the change in pressure sensor data. Pressure sensor data may therefore be acquired and analyzed to determine the target force distribution profile, such that the controller may be configured to control the viscosity of the non-Newtonian fluid in accordance with a measurement of the pressure on the device at the patient side.

A change in pressure sensor data that exceeds a predetermined threshold may indicate damage to the chest of the patient. That is, bone damage, such as, for example, to the ribs of the patient may be detected by changes to the pressure profile of pressure sensors on the patient side of the CPR Device.

The controller may be configured to periodically re-determine the target force distribution profile using the most recently acquired pressure sensor data. The controller may therefore dynamically control the viscosity of the NNF fluid on the basis of pressure more recently detected at the patient side of the device so as to maximize the effectiveness of the chest compressions delivered to the patient. For example, the pressure sensors may measure the pressure at the patient side and the controller may determine the position of the device on the chest of the patient based on the measured pressure. Alternatively or additionally, the controller may determine damage to the patient, such as, for example, broken bones, using the measured pressure. The controller may then vary the viscosity of the NNF to meet a target force distribution profile that is suitable for the position of the device and/or the damage to the patient. For example, if the measured pressure determines that there is no damage to the patient, then the controller may apply energy to the NNF that results in a relatively high viscosity so that the rigidity of the device is increased and more force is transferred to the patient. Conversely, if damage to the patient is determined from the measured pressure, then the controller may apply energy to the NNF that decreases the viscosity so that the rigidity of the device is decreased and less force is transferred to the patient so as to minimize the risk of further injury to the patient.

The controller may determine the target force distribution profile and control the variable viscosity of the NNF on the basis of information from multiple sensors, such as, for example, a force sensor, a patient sensor and a user sensor. For example, sensor data from multiple sensors may be compiled to determine the condition of the user and/or the patient, and the quality and/or force of the chest compressions. Alternatively, the most recently acquired sensor data may be used to determine the target force distribution profile and thus to control the viscosity of the NNF, regardless of the type of data. Alternatively, some sensors may be known to be more accurate, reliable and/or indicative of a condition of the patient and/or user than other sensors and so sensor data from these sensors may be weighted more favorably when analyzing the sensor data and determining the target force distribution profile. Alternatively or additionally, the sensors may be ranked and sensor data on which the target force distribution profile is determined may only be replaced when more recent data from an equally or higher ranked sensor is acquired. Sensor data may be acquired during the delivery of CPR and the viscosity of the NNF may be controlled based on the acquired data so that the viscosity is dynamically controlled during the delivery of CPR.

The present invention extends to method aspects corresponding to the device aspects.

According to an embodiment of another aspect, there is provided a control method for a cardiopulmonary resuscitation, CPR, device for enhancing the delivery of CPR to a patient, the device comprising a patient side for engagement with the chest of the patient, and a user side for engagement with the hands of a user delivering CPR to the patient, wherein one or more of the patient side and the user side is at least partially formed of a non-Newtonian fluid, the viscosity of which is configured to vary in response to the application of energy so as to regulate a force distribution profile of the device from a force applied to the device from the user and transferred through the device to the patient, the method comprising: acquiring one or more of the following data types: force data of a force applied to the device; patient sensor data relating to the condition of the patient; user sensor data relating to the condition of the user; information on the patient; information on the user; acceleration data of acceleration of the device at a plurality of time points; image data of the device positioned on the chest of the patient; and pressure sensor data of pressure applied to the device; and controlling the viscosity of the non-Newtonian fluid by applying energy to the non-Newtonian fluid so as to provide a target force distribution profile to the patient from a force applied to the device by the user in accordance with one or more of the acquired data types.

Thus, according to an embodiment of an aspect, a method of controlling the variable viscosity of a CPR device may also be provided. The variable viscosity may be controlled on the basis of one or more data types acquired from the CPR device and/or from elements of a system comprising the CPR device.

Features and sub-features of the device aspects may be applied to the method aspects and vice versa.

The present invention extends to a computer program aspect which, when executed on a computing device, carries out a control method, according to any of the method aspects of the invention or any combination thereof.

In particular, according to an embodiment of another aspect, there is provided a computer program, which, when executed on a computing device, carries out a control method for a cardiopulmonary resuscitation, CPR, device for enhancing the delivery of CPR to a patient, the device comprising a patient side for engagement with the chest of the patient, and a user side for engagement with the hands of a user delivering CPR to the patient, wherein one or more of the patient side and the user side is at least partially formed of a non-Newtonian fluid, the viscosity of which is configured to vary in response to the application of energy so as to regulate a force distribution profile of the device from a force applied to the device from the user and transferred through the device to the patient, the method comprising: acquiring one or more of the following data types: force data of a force applied to the device; patient sensor data relating to the condition of the patient; user sensor data relating to the condition of the user; information on the patient; information on the user; acceleration data of acceleration of the device at a plurality of time points; image data of the device positioned on the chest of the patient; and pressure sensor data of pressure applied to the device; and controlling the viscosity of the non-Newtonian fluid by applying energy to the non-Newtonian fluid so as to provide a target force distribution profile to the patient from a force applied to the device by the user in accordance with one or more of the acquired data types.

According to an embodiment of another aspect, there is provided a cardiopulmonary resuscitation, CPR, device for enhancing the delivery of CPR to a patient, the device comprising: a patient side for engagement with the chest of the patient; and a user side for engagement with the hands of a user delivering CPR to the patient, wherein one or more of the surface of the patient side and the surface of the user side is at least partially formed of a material with variable contact characteristics configured to be controlled so as to regulate the lateral force distribution profile at the one or more of the surface of the patient side and the surface of the user side from a force applied to the device by the user and transferred through the device to the patient.

Thus, according to embodiments of this aspect of the present invention, the surface of the device is at least partially formed of a material with variable contact characteristics, i.e. a material with contact characteristics that may be varied. The contact characteristics may be controlled so that the lateral force distribution profile at the patient side and/or the user side, in response to a force applied at the user side, for example, the force of a chest compression, may be regulated. For example, the contact characteristics may be controlled so that the lateral force of the device at the patient side is regulated by increasing and decreasing the lateral force.

It may be seen that the variable contact characteristics of the material which forms at least part of the CPR device results in a lateral force distribution profile of the device at the surface(s) comprising the material that may be controlled as a force is applied to the device by the user. The lateral force distribution profile may be considered as the distribution of lateral force by the device and, if the device is positioned on the chest of the patient and the patient side is at least partially formed of the material with variable contact characteristics, the distribution of lateral force to the chest of the patient at the patient side. Similarly, if the hands of the user engage with the user side of the device and the user side is at least partially formed of the material with variable contact characteristics, the distribution of lateral force to the hands of the user at the user side. The lateral force may be considered as the force which is parallel to the surface of the device or the surface that the device is contacting. The lateral force may be in any direction on the lateral plane.

By regulating the lateral force distribution profile, the effectiveness of the CPR delivery may be controlled and maximized. That is, the effectiveness of chest compressions applied to the patient during delivery of CPR may be regulated such that they have the greatest impact on the patient and/or the user, and/or minimize damage to the patient and/or user. The material with variable contact characteristics may therefore regulate the patient's hemodynamic activity when a force is applied to the user side of the device. For example, by controlling the material with variable contact characteristics, the position of the device may be altered or maintained so as, for example, to position the device at a position on the chest of the patient at which chest compressions may be more effective. Thus the patient's hemodynamic activity may be improved by the regulation of the lateral force distribution profile of the device by the material with variable contact characteristics. The variable contact characteristics may resist or encourage movement of the device in a particular lateral direction so as to position the device as force is applied to the device by the user. Furthermore, damage to the patient and/or user, such as, for example, damaged or broken skin and abrasions, may be minimized by controlling the contact characteristics.

The device may comprise a controller configured to control the variable contact characteristics of the material so as to provide a target lateral force distribution profile at the one or more of the surface of the patient side and the surface of the user side from a force applied to the device by the user. That is, the variable contact characteristics may be controlled by the controller so that the lateral force distribution profile of the device may be regulated by the controller to achieve a target lateral force distribution profile. The controller may be referred to as a processor.

The controller may control the variable contact characteristics of the material so as to provide a lateral force distribution profile of the device corresponding to a target lateral force distribution profile which may achieve, or may be more likely to achieve, a desired hemodynamic activity in the patient. The controller may determine the target lateral force distribution profile and then control the variable contact characteristics of the material so that the lateral force distribution profile of the device matches, or at least moves towards matching, the determined target lateral force distribution profile. Thus, one or more of the patient side and the user side may be at least partially formed of a material with variable contact characteristics configured to be dynamically controlled by the controller.

The contact characteristics may be one or more of friction and adhesion. That is, it may be considered that the material has variable friction properties and/or variable adhesion properties. Thus, the friction and/or the adhesion of the material may be controlled and varied so that the friction and/or adhesion of the material alters the lateral force distribution profile. It may be seen that an increase in adhesion and/or friction of the material may result in an increased lateral force at the surface between that surface and another surface that the device is contacting. Conversely, a reduction in adhesion and/or friction may result in a decreased lateral force at the surface between that surface and another surface that the device is contacting. The adhesive and/or frictional properties of the material may be dynamically controlled.

It will be appreciated that if the patient side is at least partially formed of a material with variable contact characteristics, then the lateral force from the device to the chest of the patient will vary as the contact characteristics are controlled. Similarly, if the user side is at least partially formed of a material with variable contact characteristics, then the force between the hands of the user and the device will vary as the contact characteristics are controlled. The lateral force distribution profile of the device may therefore be regulated by controlling the contact characteristics of the material, such as the friction and/or adhesion.

The device may comprise a force sensor configured to acquire force sensor data of a force applied to the device. The controller may be configured to determine the target lateral force distribution profile in accordance with the force sensor data. Force sensor data may therefore be acquired and analyzed to determine the target lateral force distribution profile, such that the controller is configured to control the variable contact characteristics in accordance with a measurement of the force applied to the device.

The force sensor may measure, as force sensor data, forces applied to the CPR device, such as forces applied to the device by the user during the delivery of CPR. The force sensor may be configured to measure one or more of: a lateral force, a longitudinal force and a perpendicular (normal) force. The force sensor may continuously measure forces applied to the device over a given period, at a certain point in time, or at a plurality of time points over a given period. The force sensor may acquire the force sensor data and provide it to the controller. All or only some of the force sensor data may be provided to the controller. For example, the force sensor data may only be provided to the controller if the measured force exceeds a predetermined threshold and/or if the measured force changes by a predetermined amount.

The force sensor may be provided as part of the CPR device or may be provided as part of a system comprising the device. A plurality of force sensors may be utilized, and each force sensor may measure a different type or the same type of force as another force sensor. The force sensor may also be considered as a pressure sensor.

The controller may be configured to periodically redetermine the target lateral force distribution profile using the most recently acquired force sensor data. The controller may therefore dynamically control the contact characteristics of the material on the basis of more recently determined force applied to the device so as to maximize the effectiveness of the chest compressions delivered to the patient, and/or to minimize damage to the patient and/or user. For example, the force sensor may measure the force applied to the device during a chest compression and the controller may vary the contact characteristics so that a subsequent chest compression, which is likely to be similar in force, will have the greatest positive impact on the patient.

The device may be communicably coupled with a patient sensor configured to collect patient sensor data relating to the condition of the patient. The device may be configured to receive the patient sensor data from the patient sensor. The controller may be configured to determine the target lateral force distribution profile in accordance with the patient sensor data. Patient sensor data may therefore be acquired and analyzed to determine the target lateral force distribution profile, such that the controller may be configured to control the contact characteristics of the material on the basis of the data indicating the condition of the patient. The patient sensor data may be considered as being representative of, indicative of, or related to the condition of the patient.

The patient sensor may measure, as patient sensor data, a parameter or sign of the patient that indicates a condition of the patient. For example, the patient sensor may acquire sensor data indicative of one or more of the following parameters of the patient: heart rate; blood pressure; skin condition, such as hydration, oiliness and elasticity; coronary perfusion pressure (CPP); delivery of blood to the brain; delivery of injected therapeutics around the body; detection and analysis of internal or external bleeding; detection of subcutaneous soft tissue and bone damage; and hemodynamic behavior.

The patient sensor may comprise standard ultrasound imaging or UWB radar to image and determine heart muscle and adjacent vasculature activity. The patient sensor may comprise ultrasound imaging to measure blood pressure of the patient. Additionally or alternatively, the patient sensor may comprise one or more pressure sensors to determine bone damage, such as, for example, to the ribs which may be detected via changes to the pressure profile on the CPR device. The patient sensor may measure hemodynamic behavior and predict the delivery of injected therapeutics around the circulatory system from the behavior. The patient sensor may comprise a capacitance measurement to determine hydration of the skin of the patient, an optical sensor to determine the oiliness and redness of the skin of the patient, and/or a vibrational sensor to determine elasticity of the skin of the patient.

The patient sensor may continuously measure patient parameters or signs over a given period, at a certain point in time, or at a plurality of time points over a given period. The patient sensor may acquire the patient sensor data and provide it to the controller. All or only some of the patient sensor data may be provided to the controller. For example, the patient sensor data may only be provided to the controller if the measured parameter or sign exceeds a predetermined threshold and/or if the measured parameter or sign changes by a predetermined amount.

The controller may be configured to periodically redetermine the target lateral force distribution profile using the most recently acquired patient sensor data. The controller may therefore dynamically control the contact characteristics of the material on the basis of the condition of the patient so as to deliver a lateral force distribution profile which will be most beneficial to the patient and/or user.

The patient sensor may be provided as part of the CPR device or may be provided as part of a system comprising the device. A plurality of patient sensors may be utilized, with each patient sensor measuring a parameter or sign of the patient which is different from or the same as another patient sensor.

The device may be communicably coupled with a user sensor configured to collect user sensor data relating to the condition of the user. The device may be configured to receive the user sensor data from the user sensor. The controller may be configured to determine the target lateral force distribution profile in accordance with the user sensor data. User sensor data may therefore be acquired and analyzed to determine the target lateral force distribution profile, such that the controller may be configured to control the contact characteristics of the material on the basis of the data indicating the condition of the user. The user sensor data may be considered as being representative of, indicative of, or related to the condition of the user.

The user sensor may measure, as user sensor data, a parameter or sign of the user that indicates a condition of the user. For example, the user sensor may acquire sensor data indicative of one or more of the following parameters of the user: heart rate; blood pressure; skin condition; body movements; emotional state; breathing rate; and body geometry and position.

The user sensor may comprise wearable sensors worn by the user and used to determine body movements, geometry and/or positioning. The user sensor may comprise a smart device with sensors to determine heart arrhythmias and/or blood pressure. The user sensor may comprise a camera to capture an image of the user and determine a state of the user. For example, the state may be determined by analyzing the breathing rate and/or discomfort in facial expressions in acquired images. The camera may capture an individual frame or a plurality of frames in sequence. The user sensor may comprise a capacitance measurement to determine hydration of the skin of the user, an optical sensor to determine the oiliness and redness of the skin of the user, and/or a vibrational sensor to determine elasticity of the skin of the user. The user sensor may comprise pressure or optical sensors positioned on the user side of the device to determine the heart rate of the user when the user's hands contact the user side. The user sensor may comprise a microphone configured to capture audio data of the user and the controller may be configured to analyze the captured audio data to determine a condition of the user. The user sensor may comprise a heart rate sensor configured to measure the heart rate of the user.

The user sensor may continuously measure user parameters or signs over a given period, at a certain point in time, or at a plurality of time points over a given period. The user sensor may acquire the user sensor data and provide it to the controller. All or only some of the user sensor data may be provided to the controller. For example, the user sensor data may only be provided to the controller if the measured parameter or sign exceeds a predetermined threshold and/or if the measured parameter or sign changes by a predetermined amount.

The controller may be configured to periodically redetermine the target lateral force distribution profile using the most recently acquired user sensor data. The controller may therefore dynamically control the contact characteristics of the material on the basis of the condition of the user so as to deliver a lateral force distribution profile which will be most beneficial to the patient and/or the user.

The user sensor may be provided as part of the CPR device or may be provided as part of a system comprising the device. A plurality of user sensors may be utilized, with each user sensor measuring a parameter or sign of the user which is different from or the same as another user sensor.

The device may be communicably coupled with a memory. The device may be configured to acquire information on the patient from the memory. The controller may be configured to determine the target lateral force distribution profile in accordance with the information on the patient.

The information on the patient may comprise one or more of: the age of the patient; the health of the patient; a vital sign of the patient; a medical diagnosis of the patient; and historical patient data relating to past delivery of CPR to the patient. Information on the patient may therefore be acquired and analyzed to determine the target lateral force distribution profile, such that the controller may be configured to control the contact characteristics of the material on the basis of the information on the patient.

The memory may be provided as part of the CPR device or may be provided as part of a system comprising the device. A plurality of memories may be utilized, with each memory storing information on the patient which is different from or the same as the information stored in another memory.

The device may be communicably coupled with a memory. The device may be configured to acquire information on the user from the memory. The controller may be configured to determine the target lateral force distribution profile in accordance with the information on the user.

The information on the user may comprise one or more of: the age of the user; the identity of the user; the health of the user; a vital sign of the user; a medical diagnosis of the user; historical user data relating to past delivery of CPR; body dimensions of the user; weight of the user; age of the user; medical qualifications of the user; medical training of the user; and a fitness level of the user. Information on the user may therefore be acquired and analyzed to determine the target lateral force distribution profile, such that the controller may be configured to control the contact characteristics of the material on the basis of the information on the user.

The memory may be provided as part of the CPR device or may be provided as part of a system comprising the device. A plurality of memories may be utilized, with each memory storing information on the user which is different from or the same as the information stored in another memory. Furthermore, information on the patient may be stored in the same memory or a different memory as information on the user.

The one or more of the surface of the patient side and the surface of the user side formed of the material with variable contact characteristics may be segregated into a plurality of material sections. The controller may be configured to control the variable contact characteristics of the material of a material section of the plurality of material sections independently of one or more of the other material sections of the plurality of material sections. The device may therefore comprise multiple sections or cells each formed of a material with variable contact characteristics which may be controlled independently of the contact characteristics of other sections or cells.

The friction and/or adhesion at each section may be individually controlled and the controller may determine the target lateral force distribution profile in accordance with the plurality of material sections. Thus, the material sections may provide pixelated control across the one or more of the surface of the patient side and the surface of the user side formed of the material with variable contact characteristics. For example, sufficient friction/adhesion to prevent the device slipping or moving from a position may be applied to material sections at skin areas which are not damaged, while friction/adhesion of cells at areas of where the skin is damaged may be reduced.

The controller may be configured to control the variable contact characteristics of the material using one or more of: electro-adhesion; ultrasound; and surface design. Thus the contact characteristics of the material may be controlled using one or more of the above stimuli. The type of stimuli to be used may be determined by the properties of the material and/or the application of the CPR device.

The one or more of the surface of the patient side and the surface of the user side formed of the material with variable contact characteristics may be segregated into a plurality of material sections. The material of a material section of the plurality of material sections may be different to the material of one or more of the other material sections of the plurality of material sections.

The device may be communicably coupled with a camera configured to acquire image data of the device positioned on the chest of the patient. The device may be configured to receive the image data from the camera. The controller may be configured to determine the position of the device relative to the chest of the patient and to determine the target lateral force distribution profile in accordance with the position of the device relative to the chest of the patient. Image data may therefore be acquired and analyzed to determine the target lateral force distribution profile, such that the controller may be configured to control the contact characteristics of the material in accordance with image data identifying the position of the device on the chest of the patient.

The camera may continuously capture, as image data, images over a given period, at a certain point in time, or at a plurality of time points over a given period. The camera may capture an individual frame or a plurality of frames in sequence. The camera may acquire the image data and provide it to the controller. All or only some of the image data may be provided to the controller. The controller may acquire the image data and may perform image processing to identify the device, the patient and the position of the device relative to the chest of the patient. The target lateral force distribution profile may at least partially be determined by the position of the device. For example, the friction and/or adhesion of the material may be increased or decreased so that the device moves towards, or is more likely to move towards, a target position on the chest of the patient when the user applies force to the device.

The camera may be provided as part of the CPR device or may be provided as part of a system comprising the device. A plurality of cameras may be utilized each configured to acquire image data from a different angle.

The controller may be configured to periodically re-determine the target lateral force distribution profile using the most recently acquired image data. The controller may therefore dynamically control the contact characteristics of the material on the basis of the identified position of the device relative to the chest of the patient so as to maximize the effectiveness of the chest compressions delivered to the patient and/or to minimize the damage to the patient and/or user. For example, the controller may determine the position of the device during a chest compression and the controller may vary the friction and/or adhesion of the material so that a subsequent chest compression will have the greatest positive impact on the patient at the determined location or will provide the least damage to the patient and/or user.

The device may comprise a plurality of pressure sensors disposed on the patient side of the device and each may be configured to acquire pressure sensor data of pressure applied to the device. The controller may be configured to determine the position of the device relative to the chest of the patient using the acquired pressure sensor data and to determine the target lateral force distribution profile in accordance with the position of the device relative to the chest of the patient. Pressure sensor data may therefore be acquired and analyzed to determine the target lateral force distribution profile, such that the controller may be configured to control the contact characteristics of the material in accordance with a measurement of the pressure on the device at the patient side.

The pressure sensors may measure, as pressure sensor data, the pressure at the patient side of the CPR device. The pressure sensors may continuously measure the pressure at the patient side over a given period, at a certain point in time, or at a plurality of time points over a given period. Not all of the pressure sensors may be active at the same time and the pressure sensors may be split into one or more groups with each group measuring the pressure at different points in time or at different parts of the compression cycle. The pressure sensors may acquire the pressure sensor data and provide it to the controller. All or only some of the pressure sensor data may be provided to the controller. For example, the pressure sensor data may only be provided to the controller if the measured pressure exceeds a predetermined threshold and/or if the measured pressure changes by a predetermined amount.

The controller may acquire the pressure sensor data and may perform analysis of the pressure sensor data to identify the position of the device relative to the chest of the patient. For example, higher pressure readings on the sensors may indicate that the device is positioned on bony structures such as the solar plexus and ribs, whereas lower pressure readings may indicate a position on soft tissue such as the gaps between the ribs and the edge of the diaphragm. The target lateral force distribution profile may at least partially be determined by the position of the device.

The one or more of the surface of the patient side and the surface of the user side formed of the material with variable contact characteristics may be segregated into a plurality of material sections. The controller may be configured to control the variable contact characteristics of the material of a material section of the plurality of material sections on the basis of the pressure measured at that material section and independently of one or more of the other material sections of the plurality of material sections.

The controller may be configured to determine a target position of the device relative to the chest of the patient. The controller may be configured to compare the target position with the position of the device to determine a difference between the target position and the position of the device. The controller may be configured to determine the target lateral force distribution profile in accordance with the difference so as to minimize the difference. That is, a target lateral force distribution may be determined which moves or is likely to move the device to the target position when force is applied to the device.

The device may comprise a plurality of pressure sensors disposed on the patient side of the device and each may be configured to acquire pressure sensor data of pressure applied to the device. The controller may be configured to monitor the pressure sensor data at a plurality of time points. The controller may determine a change in pressure sensor data at a second time point of the plurality of time points, which is later than a first time point of the plurality of time points. The controller may be configured to determine the target lateral force distribution profile in accordance with the change in pressure sensor data. Pressure sensor data may therefore be acquired and analyzed to determine the target lateral force distribution profile, such that the controller may be configured to control the contact characteristics of the material in accordance with a measurement of the pressure on the device at the patient side.

A change in pressure sensor data that exceeds a predetermined threshold may indicate damage to the chest of the patient. That is, bone damage, such as, for example, to the ribs of the patient may be detected by changes to the pressure profile of pressure sensors on the patient side of the CPR Device. Thus, the controller may, for example, decrease the friction and/or adhesion of the material located at positions that are identified as damaged.

The controller may be configured to periodically re-determine the target lateral force distribution profile using the most recently acquired pressure sensor data. The controller may therefore dynamically control the contact characteristics of the material on the basis of pressure detected at the patient side of the device so as to maximize the effectiveness of the chest compressions delivered to the patient and/or minimize the damage to the patient and/or the user.

The controller may be configured to determine the target lateral force distribution profile in accordance with information on the device, such as, for example, the size and/or shape of the device. The information on the device may be present and/or acquired from a memory. The controller may therefore control the variable contact characteristics in conjunction with the shape and/or size of the device such that the application of force during a compression cycle causes lateral movement of the CPR Device in a controlled manner until a desired location is reached.

The controller may control the contact characteristics of the material on the basis of information from multiple sensors, such as, for example, a force sensor, a patient sensor and a user sensor. For example, sensor data from multiple sensors may be compiled to determine the condition of the user and/or the patient, the quality and/or force of the chest compressions; and/or the position of the device on the chest of the patient. Alternatively, the most recently acquired sensor data may be used to determine the target lateral force distribution profile and thus to control the contact characteristics of the material, regardless of the type of data. Alternatively, some sensors may be known to be more accurate, reliable and/or indicative of a condition of the patient and/or user than other sensors and so sensor data from these sensors may be weighted more favorably when analyzing the sensor data and determining the target lateral force distribution profile. Alternatively or additionally, the sensors may be ranked and sensor data on which the target lateral force distribution profile is determined may only be replaced when more recent data from an equally or higher ranked sensor is acquired. Sensor data may be acquired during the delivery of CPR and the contact characteristics may be controlled base on the acquired data so that the contact characteristics are dynamically controlled during the delivery of CPR.

The present invention extends to method aspects corresponding to the device aspects.

In particular, according to an embodiment of another aspect, there is provided a control method for a cardiopulmonary resuscitation, CPR, device for enhancing the delivery of CPR to a patient, the device comprising a patient side for engagement with the chest of the patient and a user side for engagement with the hands of a user delivering CPR to the patient, wherein one or more of the surface of the patient side and the surface of the user side is at least partially formed of material with variable contact characteristics configured to be controlled so as to regulate the lateral force distribution profile at the one or more of the surface of the patient side and the surface of the user side from a force applied to the device by the user and transferred through the device to the patient, the method comprising: acquiring one or more of the following data types: force data of a force applied to the device; patient sensor data relating to the condition of the patient; user sensor data relating to the condition of the user; information on the patient; information on the user; image data of the device positioned on the chest of the patient; and pressure sensor data of pressure applied to the device; and controlling the variable contact characteristics of the material so as to provide a target lateral force distribution profile at the surface from a force applied to the device by the user in accordance with one or more of the acquired data types.

Thus, according to an embodiment of an aspect, a method of controlling the variable contact characteristics of a CPR device may also be provided. The variable contact characteristics may be controlled on the basis of one or more data types acquired from the device and/or from elements of a system comprising the CPR device.

Features and sub-features of the device aspects may be applied to the method aspects and vice versa.

The present invention extends to a computer program aspect which, when executed on a computing device, carries out a control method, according to any of the method aspects of the invention or any combination thereof.

In particular, according to an embodiment of another aspect, there is provided a computer program which, when executed on a computing device, carries out a control method for a cardiopulmonary resuscitation, CPR, device for enhancing the delivery of CPR to a patient, the device comprising a patient side for engagement with the chest of the patient and a user side for engagement with the hands of a user delivering CPR to the patient, wherein one or more of the surface of the patient side and the surface of the user side is at least partially formed of material with variable contact characteristics configured to be controlled so as to regulate the lateral force distribution profile at the one or more of the surface of the patient side and the surface of the user side from a force applied to the device by the user and transferred through the device to the patient, the method comprising: acquiring one or more of the following data types: force data of a force applied to the device; patient sensor data relating to the condition of the patient; user sensor data relating to the condition of the user; information on the patient; information on the user; image data of the device positioned on the chest of the patient; and pressure sensor data of pressure applied to the device; and controlling the variable contact characteristics of the material so as to provide a target lateral force distribution profile at the surface from a force applied to the device by the user in accordance with one or more of the acquired data types.

According to an embodiment of another aspect, there is provided a cardiopulmonary resuscitation, CPR, device for enhancing the delivery of CPR to a patient, the device comprising: a patient side for engagement with the chest of the patient; and a user side for engagement with the hands of a user delivering CPR to the patient; and an actuator configured to at least partially alter the external form of one or more of the patient side and the user side so as to regulate a shape profile of the one or more of the patient side and the user side.

Thus, according to embodiments of this aspect of the present invention, the external form of the device may be at least partially altered such that the overall shape of the device is altered. The shape profile of the device may therefore be regulated by the operation of the actuator. By regulating the shape profile of the device at the patient side and/or the user side, the effectiveness of the CPR delivery may be controlled and maximized. That is, the effectiveness of chest compressions applied to the patient during delivery of CPR may be regulated such that they have the greatest impact on the patient and/or user, and/or minimize damage to the patient and/or user. This is due to the variable shape of the device which may be altered to alter the force transferred through the device to the patient from a force applied by the user. Regulation of the shape profile may therefore regulate a force distribution profile of the device from a force applied to the device by the user and transferred through the device to the patient so as to optimize hemodynamic activity/hemodynamics of the patient. Thus the patient's hemodynamic activity may be improved by the regulation of the shape profile of the device by the actuator.

The shape profile of the device may be considered as the shape or outer/external form of the device. Thus, it comprises the external form of the user side and the external form of the patient side. Accordingly, the actuator may be operated to alter the shape of the device. It may also be appreciated that operation of the actuator may, at least partially, alter the thickness of the device.

The device may comprise a controller configured to control the actuator so as to provide a target shape profile of the one or more of the patient side and the user side. That is, the actuator may be controlled by the controller so that the shape profile of the device may be regulated by the controller to achieve a target force distribution profile. The controller may be referred to as a processor.

The target shape profile may correspond to a target force distribution profile, such that the controller operates the actuator to provide a shape profile that may provide, or may be more likely to provide, a target force distribution profile when a force is applied to the device. Thus the controller may control the actuator so as to provide a force distribution profile of the device corresponding to a target force distribution profile which may achieve, or may be more likely to achieve, a desired hemodynamic activity in the patient. The controller may determine the target force distribution profile and then operate the actuator to achieve a shape profile corresponding to a force distribution profile that matches, or at least moves towards matching, the determined target force distribution profile. Thus, the shape profile of the device may be dynamically controlled by the controller.

The controller may be configured to activate and deactivate the actuator so as to compress and expand the actuator. That is, the operation of the actuator by the controller may cause the actuator to compress or expand. Depending on the positioning and orientation of the actuator in the device, compression and expansion of the actuator may cause at least a portion of the external form of the user side or the patient side to compress and expand, respectively. For example, the controller may cause the actuator to expand such that a portion of the user side and/or patient side protrudes above the rest of that side.

The device may comprise a force sensor configured to acquire force data of a force applied to the device. The controller may be configured to determine the target shape profile in accordance with the force data. Force sensor data may therefore be acquired and analyzed to determine the target shape profile, such that the controller is configured to control the actuator in accordance with a measurement of the force applied to the device. Force sensor data may therefore be acquired and analyzed to determine the target shape profile, such that the controller may be configured to control the actuator in accordance with a measurement of the force applied to the device.

The force sensor may measure, as force sensor data, forces applied to the CPR device, such as forces applied to the device by the user during the delivery of CPR. The force sensor may be configured to measure one or more of: a lateral force, a longitudinal force and a perpendicular (normal) force. The force sensor may continuously measure forces applied to the device over a given period, at a certain point in time, or at a plurality of time points over a given period. The force sensor may acquire the force sensor data and provide it to the controller. All or only some of the force sensor data may be provided to the controller. For example, the force sensor data may only be provided to the controller if the measured force exceeds a predetermined threshold and/or if the measured force changes by a predetermined amount.

The force sensor may be provided as part of the CPR device or may be provided as part of a system comprising the device. A plurality of force sensors may be utilized, and each force sensor may measure a different type or the same type of force as another force sensor. The force sensor may also be considered as a pressure sensor.

The controller may be configured to periodically redetermine the target shape profile using the most recently acquired force sensor data. The controller may therefore dynamically control the operation of the actuator on the basis of force applied to the device so as to maximize the effectiveness of the chest compressions delivered to the patient and/or to minimize damage to the patient and/or user. For example, the force sensor may measure the force applied to the device during a chest compression and the controller may vary the actuator so that a subsequent chest compression, which is likely to be similar in force, will have the greatest positive impact on the patient. For example, if the measured force is relatively low, then the controller may expand the actuator so that the size of the device is increased and more force is transferred to the patient. Conversely, if the measured force is relatively high, then the controller may compress the actuator so that the size of the device is decreased and less force is transferred to the patient so as to minimize the risk of injury to the patient and/or user.

The device may be communicably coupled with a patient sensor configured to collect patient sensor data relating to the condition of the patient. The device may be configured to receive the patient sensor data from the patient sensor. The controller may be configured to determine the target shape profile in accordance with the patient sensor data. Patient sensor data may therefore be acquired and analyzed to determine the target shape profile, such that the controller may be configured to control the actuator on the basis of the data indicating the condition of the patient. The patient sensor data may be considered as being representative of, indicative of, or related to the condition of the patient.

The patient sensor may measure, as patient sensor data, a parameter or sign of the patient that indicates a condition of the patient. For example, the patient sensor may acquire sensor data indicative of one or more of the following parameters of the patient: heart rate; blood pressure; skin condition, such as hydration, oiliness and elasticity; coronary perfusion pressure (CPP); delivery of blood to the brain; delivery of injected therapeutics around the body; detection and analysis of internal or external bleeding; detection of subcutaneous soft tissue and bone damage; and hemodynamic behavior.

The patient sensor may comprise standard ultrasound imaging or UWB radar to image and determine heart muscle and adjacent vasculature activity. The patient sensor may comprise ultrasound imaging to measure blood pressure of the patient. Additionally or alternatively, the patient sensor may comprise one or more pressure sensors to determine bone damage, such as, for example, to the ribs which may be detected via changes to the pressure profile on the CPR device. The patient sensor may measure hemodynamic behavior and predict the delivery of injected therapeutics around the circulatory system from the behavior. The patient sensor may comprise a capacitance measurement to determine hydration of the skin of the patient, an optical sensor to determine the oiliness and redness of the skin of the patient, and/or a vibrational sensor to determine elasticity of the skin of the patient. The patient sensor may comprise a camera configured to capture images of the patient and the controller may be configured to determine a condition of the patient by analyzing the captured images. The camera may capture an individual frame or a plurality of frames in sequence.

The patient sensor may continuously measure patient parameters or signs over a given period, at a certain point in time, or at a plurality of time points over a given period. The patient sensor may acquire the patient sensor data and provide it to the controller. All or only some of the patient sensor data may be provided to the controller. For example, the patient sensor data may only be provided to the controller if the measured parameter or sign exceeds a predetermined threshold and/or if the measured parameter or sign changes by a predetermined amount.

The controller may be configured to periodically redetermine the target shape profile using the most recently acquired patient sensor data. The controller may therefore dynamically control the actuator on the basis of the condition of the patient so as to deliver a shape profile which will be most beneficial to the patient.

The patient sensor may be provided as part of the CPR device or may be provided as part of a system comprising the device. A plurality of patient sensors may be utilized, with each patient sensor measuring a parameter or sign of the patient which is different from or the same as another patient sensor.

The device may be communicably coupled with a user sensor configured to collect user sensor data relating to the condition of the user. The device may be configured to receive the user sensor data from the user sensor. The controller may be configured to determine the target shape profile in accordance with the user sensor data. User sensor data may therefore be acquired and analyzed to determine the target shape profile, such that the controller may be configured to control the actuator on the basis of the data indicating the condition of the user. The user sensor data may be considered as being representative of, indicative of, or related to the condition of the user.

The user sensor may measure, as user sensor data, a parameter or sign of the user that indicates a condition of the user. For example, the user sensor may acquire sensor data indicative of one or more of the following parameters of the user: heart rate; blood pressure; skin condition; body movements; emotional state; breathing rate; and body geometry and position.

The user sensor may comprise wearable sensors worn by the user and used to determine body movements, geometry and/or positioning. The user sensor may comprise a smart device with sensors to determine heart arrhythmias and/or blood pressure. The user sensor may comprise a camera to capture an image of the user and determine a state of the user. For example, the state may be determined by analyzing the breathing rate and/or discomfort in facial expressions in acquired images. The camera may capture an individual frame or a plurality of frames in sequence. The user sensor may comprise a capacitance measurement to determine hydration of the skin of the user, an optical sensor to determine the oiliness and redness of the skin of the user, and/or a vibrational sensor to determine elasticity of the skin of the user. The user sensor may comprise pressure or optical sensors positioned on the user side of the device to determine the heart rate of the user when the user's hands contact the user side. The user sensor may comprise a microphone configured to capture audio data of the user and the controller may be configured to analyze the captured audio data to determine a condition of the user. The user sensor may comprise a heart rate sensor configured to measure the heart rate of the user.

The user sensor may continuously measure user parameters or signs over a given period, at a certain point in time, or at a plurality of time points over a given period. The user sensor may acquire the user sensor data and provide it to the controller. All or only some of the user sensor data may be provided to the controller. For example, the user sensor data may only be provided to the controller if the measured parameter or sign exceeds a predetermined threshold and/or if the measured parameter or sign changes by a predetermined amount.

The controller may be configured to periodically redetermine the target shape profile using the most recently acquired user sensor data. The controller may therefore dynamically control the actuator on the basis of the condition of the user so as to deliver a shape profile which will be most beneficial to the patient and/or the user.

The user sensor may be provided as part of the CPR device or may be provided as part of a system comprising the device. A plurality of user sensors may be utilized, with each user sensor measuring a parameter or sign of the user which is different from or the same as another user sensor.

The device may be communicably coupled with a memory configured to store information on the patient. The device may be configured to acquire information on the patient from the memory. The controller may be configured to determine the target shape profile in accordance with the information on the patient.

The information on the patient may comprise one or more of: the age of the patient; the health of the patient; a vital sign of the patient; a medical diagnosis of the patient; and historical patient data relating to past delivery of CPR to the patient. Information on the patient may therefore be acquired and analyzed to determine the target shape profile, such that the controller may be configured to control the actuator on the basis of the information on the patient.

The memory may be provided as part of the CPR device or may be provided as part of a system comprising the device. A plurality of memories may be utilized, with each memory storing information on the patient which is different from or the same as the information stored in another memory.

The device may be communicably coupled with a memory configured to store information on the user. The device may be configured to acquire information on the user from the memory. The controller may be configured to determine the target shape profile in accordance with the information on the user.

The information on the user may comprise one or more of: the age of the user; the identity of the user; the health of the user; a vital sign of the user; a medical diagnosis of the user; historical user data relating to past delivery of CPR; body dimensions of the user; weight of the user; age of the user; medical qualifications of the user; medical training of the user; and a fitness level of the user. Information on the user may therefore be acquired and analyzed to determine the target shape profile, such that the controller may be configured to control the actuator on the basis of the information on the user.

The memory may be provided as part of the CPR device or may be provided as part of a system comprising the device. A plurality of memories may be utilized, with each memory storing information on the user which is different from or the same as the information stored in another memory. Furthermore, information on the patient may be stored in the same memory or a different memory as information on the user.

The device may be communicably coupled with a camera configured to acquire image data of the device positioned on the chest of the patient. The device may be configured to receive the image data from the camera. The controller may be configured to determine the position of the device relative to the chest of the patient using the image data and to determine the target shape profile in accordance with the position of the device relative to the chest of the patient. Image data may therefore be acquired and analyzed to determine the target shape profile, such that the controller may be configured to control the actuator in accordance with image data identifying the position of the device on the chest of the patient.

The camera may continuously capture, as image data, images over a given period, at a certain point in time, or at a plurality of time points over a given period. The camera may capture an individual frame or a plurality of frames in sequence. The camera may acquire the image data and provide it to the controller. All or only some of the image data may be provided to the controller. The controller may acquire the image data and may perform image processing to identify the device, the patient and the position of the device relative to the chest of the patient. The target shape profile may at least partially be determined by the position of the device. For example, certain positions on the chest of the patient may be more suited to a device with a larger external shape and certain positions may be more suited to a smaller device.

The camera may be provided as part of the CPR device or may be provided as part of a system comprising the device. A plurality of cameras may be utilized each configured to acquire image data from a different angle.

The controller may be configured to periodically re-determine the target shape profile using the most recently acquired image data. The controller may therefore dynamically control the actuator on the basis of the identified position of the device relative to the chest of the patient so as to maximize the effectiveness of the chest compressions delivered to the patient. For example, the controller may determine the position of the device during a chest compression and the controller may operate the actuator so that a subsequent chest compression will have the greatest positive impact on the patient at the determined location.

The device may comprise a plurality of pressure sensors disposed on the patient side of the device and each may be configured to acquire pressure sensor data of pressure applied to the device. The controller may be configured to determine the position of the device relative to the chest of the patient using the acquired pressure sensor data and to determine the target shape profile in accordance with the position of the device relative to the chest of the patient. Pressure sensor data may therefore be acquired and analyzed to determine the target shape profile, such that the controller may be configured to control the actuator in accordance with a measurement of the pressure on the device at the patient side.

The pressure sensors may measure, as pressure sensor data, the pressure at the patient side of the CPR device. The pressure sensors may continuously measure the pressure at the patient side over a given period, at a certain point in time, or at a plurality of time points over a given period. Not all of the pressure sensors may be active at the same time and the pressure sensors may be split into one or more groups with each group measuring the pressure at different points in time or at different parts of the compression cycle. The pressure sensors may acquire the pressure sensor data and provide it to the controller. All or only some of the pressure sensor data may be provided to the controller. For example, the pressure sensor data may only be provided to the controller if the measured pressure exceeds a predetermined threshold and/or if the measured pressure changes by a predetermined amount.

The controller may acquire the pressure sensor data and may perform analysis of the pressure sensor data to identify the position of the device relative to the chest of the patient. For example, higher pressure readings on the sensors may indicate that the device is positioned on bony structures such as the solar plexus and ribs, whereas lower pressure readings may indicate a position on soft tissue such as the gaps between the ribs and the edge of the diaphragm. The target shape profile may at least partially be determined by the position of the device. For example, certain positions on the chest of the patient may require an at least partially increased external form.

The controller may be configured to determine a target position of the device relative to the chest of the patient. The controller may be configured to compare the target position with the position of the device to determine a difference between the target position and the position of the device. The controller may be configured to determine the target shape profile in accordance with the difference so as to minimize the difference. That is, a target shape profile may be determined which moves or is likely to move the device to the target position when force is applied to the device.

The device may comprise a plurality of pressure sensors disposed on the patient side of the device and each may be configured to acquire pressure sensor data of pressure applied to the device. The controller may be configured to monitor the pressure sensor data at a plurality of time points. The controller may determine a change in pressure sensor data at a second time point of the plurality of time points, which is later than a first time point of the plurality of time points. The controller may be configured to determine the target shape profile in accordance with the change in pressure sensor data. Pressure sensor data may therefore be acquired and analyzed to determine the target shape profile, such that the controller may be configured to control the actuator in accordance with a measurement of the pressure on the device at the patient side.

A change in pressure sensor data that exceeds a predetermined threshold may indicate damage to the chest of the patient. That is, bone damage, such as, for example, to the ribs of the patient may be detected by changes to the pressure profile of pressure sensors on the patient side of the CPR Device.

The controller may be configured to periodically re-determine the target shape profile using the most recently acquired pressure sensor data. The controller may therefore dynamically control the actuator on the basis of pressure detected at the patient side of the device so as to maximize the effectiveness of the chest compressions delivered to the patient. For example, the pressure sensors may measure the pressure at the patient side and the controller may determine the position of the device on the chest of the patient based on the measured pressure. Alternatively or additionally, the controller may determine damage to the patient, such as, for example, broken bones, using the measured pressure. The controller may then operate the actuator to meet a target shape profile that is suitable for the position of the device and/or the damage to the patient.

The device may comprise a plurality of actuators. The controller may be configured to control a first actuator of the plurality of actuators independently of one or more of the other actuators of the plurality of actuators. The device may therefore comprise multiple actuators and each actuator may be controlled independently of other actuators. Thus, individual actuator operation may provide pixelated control across the user side and/or the patient side. That is, a portion of the external form of the user side and/or the patient side may be altered independently of another portion of that side. The alteration of the external form may therefore be localized to a positon corresponding to an actuator. The controller may determine the target shape profile in accordance with the plurality of actuators.

The device may comprise a plurality of actuators each provided with a corresponding pressure sensor. The controller may be configured to control a first actuator of the plurality of actuators based on the pressure measured by the corresponding pressure sensor and independently of one or more of the other actuators of the plurality of actuators.

The actuator may be a hydraulically amplified self-healing electrostatic actuator. The device may comprise an array of hydraulically amplified self-healing electrostatic (HASEL) actuators that may be embedded in one or more of the user side and the patient side and covered with a flexible surface. The flexible surface may be filled with a non-Newtonian fluid, such as, for example, a shear thickening fluid. Electrical activation of one actuator may result in a change of thickness of the device at the position of the actuator relative to neighboring actuators, resulting in the surface forming a slope between actuators. The shape profile and resultant force distribution profile of the device may therefore be regulated by controlling the actuators.

The controller may be configured to control the actuator such that a portion of the one or more of the patient side and the user side protrudes from the surface of the one or more of the patient side and the user side. That is, the actuator may be operated to cause a section of the user side and/or patient side to protrude above the rest of the surface of that side. A perpendicular force applied to the device, such as from a user, may therefore be transformed to also include a lateral component as well as a perpendicular component. The shape profile and resultant force distribution profile of the device may therefore be regulated by controlling the actuator.

The present invention extends to method aspects corresponding to the device aspects.

In particular, according to an embodiment of another aspect, there is provided a control method for a cardiopulmonary resuscitation, CPR, device for enhancing the delivery of CPR to a patient, the device comprising a patient side for engagement with the chest of the patient, a user side for engagement with the hands of a user delivering CPR to the patient, and an actuator configured to at least partially alter the external form of one or more of the patient side and the user side so as to regulate a shape profile of the one or more of the patient side and the user side, the method comprising: acquiring one or more of the following data types: force data of a force applied to the device; patient sensor data relating to the condition of the patient; user sensor data relating to the condition of the user; information on the patient; information on the user; acceleration data of acceleration of the device at a plurality of time points; image data of the device positioned on the chest of the patient; and pressure sensor data of pressure applied to the device; and controlling the actuator so as to provide a target shape profile of the one or more of the patient side and the user side in accordance with one or more of the acquired data types.

Thus, according to an embodiment of an aspect, a method of controlling the shape profile of a CPR device may also be provided. An actuator of the device may be controlled so as to at least partially alter the external form of the CPR device on the basis of one or more data types acquired from the device and/or from elements of a system comprising the CPR device.

Features and sub-features of the device aspects may be applied to the method aspects and vice versa.

The present invention extends to a computer program aspect which, when executed on a computing device, carries out a control method, according to any of the method aspects of the invention or any combination thereof.

In particular, according to an embodiment of another aspect, there is provided a computer program which, when executed on a computing device, carries out a control method for a cardiopulmonary resuscitation, CPR, device for enhancing the delivery of CPR to a patient, the device comprising a patient side for engagement with the chest of the patient, a user side for engagement with the hands of a user delivering CPR to the patient, and an actuator configured to at least partially alter the external form of one or more of the patient side and the user side so as to regulate a shape profile of the one or more of the patient side and the user side, the method comprising: acquiring one or more of the following data types: force data of a force applied to the device; patient sensor data relating to the condition of the patient; user sensor data relating to the condition of the user; information on the patient; information on the user; acceleration data of acceleration of the device at a plurality of time points; image data of the device positioned on the chest of the patient; and pressure sensor data of pressure applied to the device; and controlling the actuator so as to provide a target shape profile of the one or more of the patient side and the user side in accordance with one or more of the acquired data types.

The above aspects may be combined with one or more of the other aspects, such that the CPR device may comprise more than one variable property and the control method aspects may similarly be combined. The present invention therefore extends to a CPR device and corresponding control method in which the CPR device is at least partially formed of a material with variable viscosity and/or is at least partially formed of a material with variable contact characteristics and/or comprises an actuator configured to at least partially alter the external form of the device. Features of the various aspects apply to the other aspects mutatis mutandis, and vice versa.

The user side of the device is suitable for engagement with the hands of the user and the patient side is suitable for engagement with the chest of the patient such that the CPR device may be disposed between the chest of the patient and the hands of the user during delivery of CPR. That is, the CPR device may be positioned on the chest of the patient and the user may engage with the CPR device when providing chest compressions during the delivery of CPR.

The term patient may be used to describe an individual that is suffering, or is suspected of suffering, cardiac arrest, i.e. a sudden loss of blood flow resulting from the failure of the heart to effectively pump. The patient is therefore an individual to whom cardiopulmonary resuscitation (CPR), comprising chest compressions, is being administered.

The term user may be used to describe an individual or rescuer that is preparing to deliver CPR (or at least the chest compressions of CPR) to the patient, or is delivering CPR (or at least the chest compressions of CPR) to the patient. The user may be considered as an individual that uses the CPR device and the user may position the CPR device on the chest of the patient prior to starting CPR. The user may also be a machine that provides chest compressions to the patient during the delivery of CPR, with the CPR device positioned between the chest of the patient and the machine delivering chest compressions. If a machine is utilized, then the controller may acquire machine data from the machine indicating the force of the compressions to be delivered and may control the one or more variable properties of the CPR device in accordance with the machine data.

The size and shape of the CPR device may vary and may, for example, be determined by the intended application of the device. The device may be designed with specific properties (size, stiffness etc.) tailored to different groups (such as children, adults or the elderly). For example, the size and shape of a CPR device intended for use with children may be different from the size and shape of a CPR device intended for use with an adult. Similarly, the variance in the variable properties of the device may vary and may vary according to the intended application. For example, considering a device intended for use with children, the maximum viscosity of the NNF may be less than that of a device intended for use with adults. Similarly, the variable contact characteristics of a device for use with children may be different to the variable contact characteristics of a device for use with adults such that the lateral force distribution profile of the children's device has a smaller magnitude than the lateral force distribution profile of the adult's device. Finally, for a CPR device with a variable shape profile, the magnitude of variance in the shape of the device may be less for a device intended for use on children than for a device intended for use on adults.

The CPR device comprising the user side and the patient side may also be referred to as a puck or a CPR puck. The CPR device according to embodiments of aspects of the present invention may also be provided as part of a CPR system comprising the CPR device and associated devices for acquiring data that may be used to determine the control of the CPR device. For example, a CPR system may comprise the CPR device according to embodiments of aspects of the present invention and one or more of the following elements: a force sensor, a patient sensor, a user sensor, a memory, an accelerometer, an imaging device and a pressure sensor. The system may comprise one or more of each of the elements.

Embodiments of the present invention therefore extend to a CPR device and a system comprising the CPR device and further relevant devices and/or elements. Features of the device aspects apply to the system aspects mutatis mutandis, and vice versa.

Aspects of the invention, such as, for example, the controller, may be implemented in digital electronic circuitry, or in computer hardware, firmware, software, or in combinations of them. Aspects of the invention may be implemented as a computer program or computer program product, i.e., a computer program tangibly embodied in an information carrier, e.g., in a machine-readable storage device or in a propagated signal, for execution by, or to control the operation of, one or more hardware modules. A computer program may be in the form of a stand-alone program, a computer program portion or more than one computer program and may be written in any form of programming language, including compiled or interpreted languages, and it may be deployed in any form, including as a stand-alone program or as a module, component, subroutine, or other unit suitable for use in a communication system environment. A computer program may be deployed to be executed on one module or on multiple modules at one site or distributed across multiple sites and interconnected by a communication network. Elements that are communicably coupled may be connected to the same network.

Aspects of the method steps of the invention may be performed by one or more programmable processors executing a computer program to perform functions of the invention by operating on input data and generating output. Aspects of the apparatus of the invention may be implemented as programmed hardware or as special purpose logic circuitry, including e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for executing instructions coupled to one or more memory devices for storing instructions and data.

It may therefore be seen that embodiments of the present invention may provide means for enhancing the delivery of CPR to a patient by providing a CPR device with one or more variable properties and a control method for the CPR device. One or more properties of the device may vary during the delivery of CPR to the patient such that the interaction between the device and the patient and/or the device and the user may not be consistent throughout the delivery of CPR. The risk of injury to the patient and/or the user during the delivery of CPR may be reduced by the one or more variable properties of the CPR device.

BRIEF DESCRIPTION OF THE DRAWINGS

Embodiments of the present disclosure may take form in various components and arrangements of components, and in various steps and arrangements of steps. Accordingly, the drawings are for purposes of illustrating the various embodiments and are not to be construed as limiting the embodiments. In the drawing figures, like reference numerals refer to like elements. In addition, it is to be noted that the figures may not be drawn to scale.

DETAILED DESCRIPTION OF EMBODIMENTS

Figure 1:
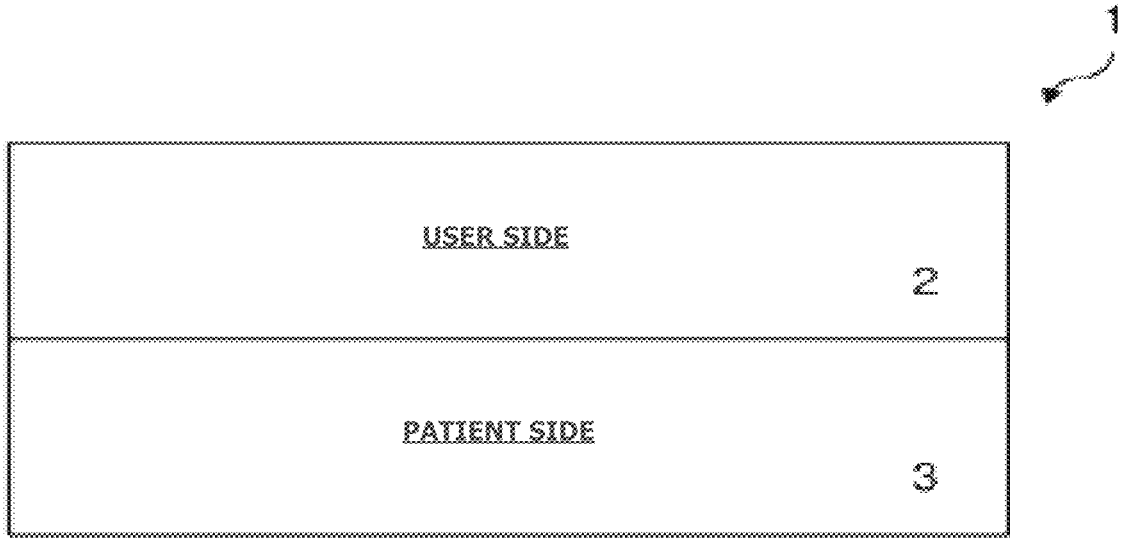
FIG. 1 is a block diagram of a cardiopulmonary resuscitation, CPR, device according to a general embodiment of the invention.

The embodiments of the present disclosure and the various features and advantageous details thereof are explained more fully with reference to the non-limiting examples that are described and/or illustrated in the drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the present disclosure. The examples used herein are intended merely to facilitate an understanding of ways in which the embodiments of the present may be practiced and to further enable those of skill in the art to practice the same. Accordingly, the examples herein should not be construed as limiting the scope of the embodiments of the present disclosure, which is defined solely by the appended claims and applicable law.

It is understood that the embodiments of the present disclosure are not limited to the particular methodology, protocols, devices, apparatus, materials, applications, etc., described herein, as these may vary. It is also to be understood that the terminology used herein is used for the purpose of describing particular embodiments only, and is not intended to be limiting in scope of the embodiments as claimed. It must be noted that as used herein and in the appended claims, the singular forms "a," "an," and "the" include plural reference unless the context clearly dictates otherwise.

Unless defined otherwise, all technical and scientific terms used herein have the same meanings as commonly understood by one of ordinary skill in the art to which the embodiments of the present disclosure belong. Preferred methods, devices, and materials are described, although any methods and materials similar or equivalent to those described herein may be used in the practice or testing of the embodiments.

As discussed above, it is desirable to enhance the delivery of CPR to the user so that the CPR are more effective and the benefit of the CPR to the patient is increased. It is also desirable to minimize the risk of damage to the patient and/or user during the delivery of CPR.

Embodiments of the present invention provide a CPR device, a control method and a computer program. The CPR device may comprise one or more variable properties that may be altered so as to regulate a profile of the CPR device. When utilized during the delivery of CPR, in particular during the delivery of chest compressions, the one or more variable properties may change in response to stimuli and may also be controlled. Accordingly, the one or more variable properties may alter the interaction of the device with the patient and/or the user during delivery of CPR and may be enhance the delivery of CPR to the patient. The risk of damage to the patient and/or user during the delivery of CPR may also be minimized by the one or more variable properties of the device. This may be achieved by maintaining the correct and consistent depth and full release during CPR compression cycles which may be difficult to achieve otherwise.

FIG. 1 shows a block diagram of a cardiopulmonary resuscitation, CPR, device according to a general embodiment of the invention. The CPR device 1 comprises a user side 2 and a patient side 3. The patient side 3 is suitable for engagement with the chest of a patient. The user side 2 is suitable for engagement with the hands of a user delivering CPR to the patient. The CPR device 1 may further comprise a controller (not shown). Either or both of the user side 2 and the patient side 3 may be provided with one or more variable properties, such as a non-Newtonian fluid with variable viscosity, a material with variable contact characteristics or an actuator to vary the external form of the device.

Figure 2:
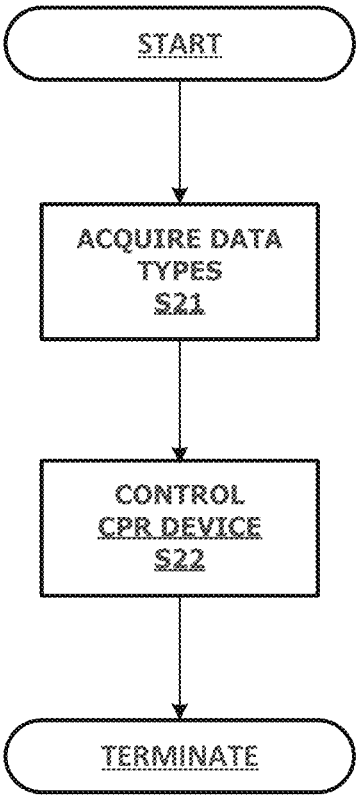
FIG. 2 is a flow chart of a control method for a cardiopulmonary resuscitation, CPR, device according to a general embodiment of the invention.

FIG. 2 shows a flow chart of a control method for a cardiopulmonary resuscitation, CPR, device according to a general embodiment of the invention. At step S21, one or more data types are acquired. The data types may include force data of a force applied to the device; patient sensor data relating to the condition of the patient; user sensor data relating to the condition of the user; information on the patient; information on the user; acceleration data of acceleration of the device at a plurality of time points; image data of the device positioned on the chest of the patient; and pressure sensor data of pressure applied to the device. At step S22 one or more variable properties of the CPR device is controlled in accordance with the one or more of the acquired data types. The variable properties may be a non-Newtonian fluid with variable viscosity, a material with variable contact characteristics or an actuator to vary the external form of the device.

The NNF may be a shear thickening fluid (STF). STFs are non-Newtonian fluids whose properties vary based on the application of a shear force. They are soft and conformable at low levels of force, but stiffen and behave more like a solid when a higher level of force is applied. The formulation of STFs may be adjusted to tune the properties of the fluid, including viscosity, critical shear rate, storage modulus, and loss modulus. Additionally, increased understanding of STFs has enabled their properties to be changed dynamically using for example electrical fields, magnetic fields or vibrations. Such STFs may be incorporated into CPR devices according to embodiments of aspects of the present invention. That is, the user side of the CPR device may be at least partially formed of an STF with properties that may be tuned and controlled. Alternatively or additionally, the patient side may be at least partially formed of an STF with properties that may be tuned and controlled.

Flexible sensors enable a range of sensing capabilities on conformable surfaces, such as, for example, pressure, optical, temperature and inertia. Such flexible sensors may therefore be incorporated into CPR devices according to embodiments of aspects of the present invention so as to acquire sensor data of measurements taken from the patient, the user and/or the CPR delivery. The sensor data may then be used to control the one or more variable properties of the CPR device.

As discussed above, one or more of the patient side and the user side of the device may be at least partially formed of a material with variable contact characteristics. Various methods exist to dynamically control the adhesive and frictional properties of materials, including electro adhesion, ultrasound and novel surface designs. Such methods may therefore be incorporated into to CPR devices according to embodiments of aspects of the present invention so as to achieve a device which may have variable contact characteristics on at least a portion of its surface.

During the delivery of CPR and, in particular, the chest compressions administered to the patient during the delivery of CPR, the optimal compression force profile over the chest area varies significantly among patients due to inter-individual differences. That is, the optimum compression depth and thus the force required to achieve the depth varies between patients. Although the specific force required for optimal compression depth differs between individuals, ranges have been identified for different patient groups (such as, adults, children, infants, the elderly, males, females etc.). For example, the forces required for males and females are in the ranges 320±80 N and 270±70 N, respectively. The ranges of the one or more variable properties of CPR devices according to embodiments of aspects of the present invention may therefore be determined in accordance with the patient group upon which a device is intended to be used and the desired forces associated with that patient group.

Computational methods enable heart muscle and adjacent vasculature activity to be analyzed in real time using, for example, ultrasound and ultra-wideband (UWB radar). Blood pressure may also be measured using ultrasound. Such analysis of heart muscle and blood flow activity may be utilized with CPR devices according to embodiments of aspects of the present invention to monitor the condition of the patient so that the one or more variable properties of the CPR device may be controlled in accordance with the condition of the patient.

Wearable radar may use artificial intelligence (AI) to identify subtle body movements. Sensors in smart devices are able to measure heart arrhythmias and blood pressure. Skin condition may be determined with simple sensors. Emotions may be determined using, for example, a smartphone camera and facial recognition. Such body analysis using consumer-grade wearables and smartphone technologies may be utilized with CPR devices according to embodiments of aspects of the present invention so as to monitor the condition of the user so that the one or more variable properties of the CPR device may be controlled in accordance with the condition of the user.

One or more of the properties of CPR devices according to embodiments of aspects of the present invention, such as, for example, shape, stiffness and adhesion, may be varied in real time using soft actuators, electro-adhesion and active shear-thickening materials.

According to embodiments of aspects of the present invention, there is provided a CPR device with dynamically adjustable properties (including shape, stiffness, friction and adhesion). The properties may be dynamically adjusted to optimize, for an individual patient and rescuer (user), the spatial and temporal force delivery profile so as to achieve desired CPR qualities, such as, for example, hemodynamic activity, while minimizing damage to the patient and/or rescuer. The properties may be dynamically adjusted in view of the compression forces delivered by the rescuer. The optimization is based on real-time analysis of the patient and/or the rescuer during compressions under varying force profiles.

The main steps according to embodiments of aspects of the present invention may be summarized as follows:

Analysis of the CPR quality based on current compressions. CPR quality measurements may include an analysis of hemodynamic activity of the patient.

Analysis of patient condition, including the skin condition under the CPR device.

Optionally, analysis of the rescuer condition, including the skin condition in contact with the CPR device, and the level of fatigue of the rescuer.

Selection of a set of CPR device parameters such as shape, stiffness and adhesion/friction properties, designed to create a force profile on the chest of the patient that optimizes CPR quality and minimizes patient and/or rescuer injury, based on the previous analyses.

Hence, embodiments of aspects of the present invention may provide the following described features.

A system to control a patient's hemodynamics during CPR by adjusting the force profile of the device of a force applied to the chest based on an evaluation of the optimum force profile to achieve a desired hemodynamic activity for the individual patient. Activities that may be controlled include:

Delivery of blood to the brain.

Delivery of therapeutics around the body.

Detection, analysis and prevention/reduction of internal or external bleeding.

A CPR device actuator system to modify one or more properties of a CPR device, including shape, stiffness and adhesion/friction, with the ability to create a force distribution output based on, but different from, a force distribution input, i.e. the force output to the patient from a force input by the user. The system includes:

Shape control, using actuators to adjust the shape of the device.

Stiffness control, using non-Newtonian fluids such as shear-thickening materials that stiffen in response to a force applied either by the rescuer performing CPR or by activators in the device.

Adhesion and friction control, using materials with variable adhesion properties to facilitate positioning and maintenance of the CPR device in position.

A system to reduce injury to the patient and/or rescuer via the monitoring of the effect of CPR on the patient and/or rescuer and the adjustment of CPR device properties including shape, stiffness and adhesion/friction to reduce the impact. For example, to reduce friction or repetitive strain. The system may reduce injury to the patient during administration of CPR through temporal and spatial control of the perpendicular force applied during manual CPR compressions.

A control unit to calculate the optimum CPR device parameters to apply to a patient's chest to achieve a desired hemodynamic outcome for a given force input. That is, to determine a target output force profile of the device from a force applied to the device by a rescuer (user).

Figure 3:
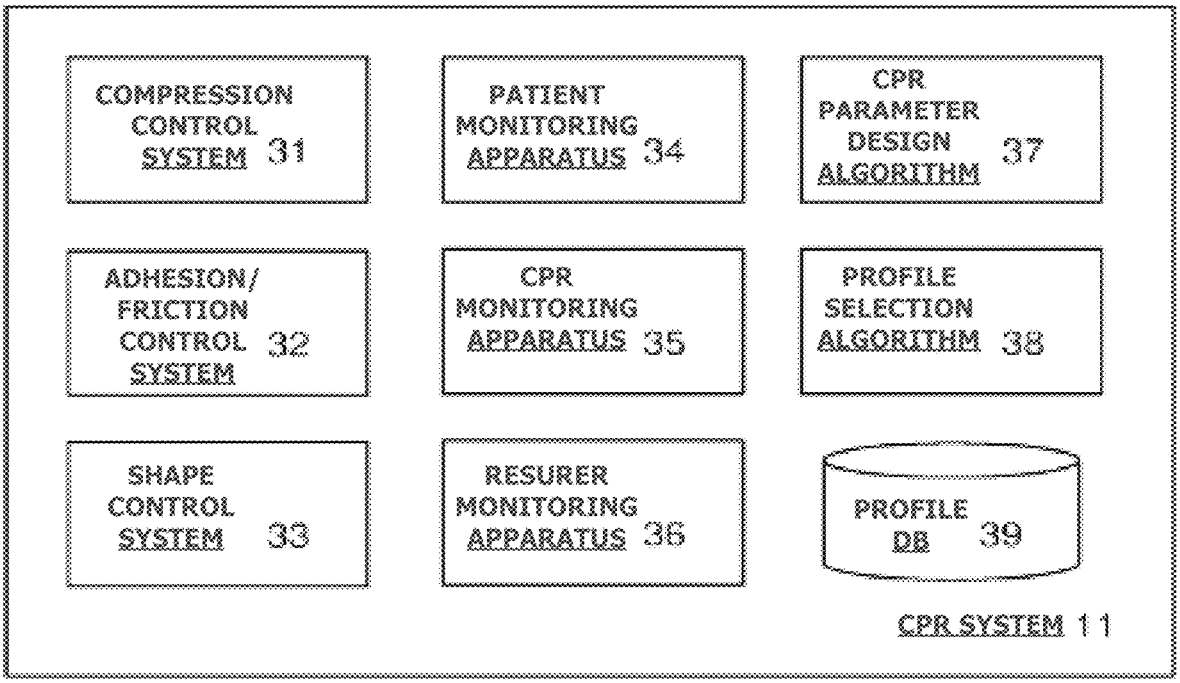
FIG. 3 is a block diagram of a CPR system according to an embodiment of an aspect of the invention.

FIG. 3 shows a block diagram of a CPR system 11 according to an embodiment of an aspect of the invention. The CPR system 11 is designed to assist in the administration of CPR to a patient in cardiac arrest by dynamically adjusting the force transfer profile of a CPR device from the rescuer (user) to the patient in such a way that CPR qualities, such as hemodynamic activity, may be optimized given the compressions provided by the rescuer. Adjustments to the force profile may be made by changing parameters in the CPR device (the 'device parameters'), including the shape profile, stiffness profile and adhesion/friction profile.

The CPR system 11 may comprise a compression control system 31, an adhesion/friction control system 32, a shape control system 33, a patient monitoring apparatus 34, a CPR monitoring apparatus 35, a rescuer (user) monitoring apparatus 36, a CPR parameter design algorithm 37, a profile selection algorithm 38 and a profile database 39.

The compression control system 31 provides temporal and spatial control of the perpendicular force applied during manual CPR compressions. This may consist of a non-Newtonian fluid, such as a shear-thickening (STF) material, which covers the device and conforms to the shape of the patient's chest and the rescuer's hands. The stiffness of the STF and thus the device changes during application of force to ensure efficient transfer of force from the rescuer to the patient.

The device may comprise multiple cells containing STF such that the stiffness of each cell can be controlled independently and dynamically, to provide pixelated control across the area of contact with the chest thus enabling the location of the compression force to be controlled on each compression.

The stiffness of the fluid may be controlled using various stimuli, including (ultra)sonic, electrical or magnetic stimuli and the stimuli may depend on the properties of the STF. For example, ultrasonic transducers placed in each STF cell may be activated to modulate the stiffness of the STF independently of the force applied by the rescuer. In the absence of any stimuli, the STF will stiffen on application of adequate force by the rescuer, due to the properties of STFs. Thus efficient transfer of force from the rescuer to the patient may be enabled while still the device is still able to conform to the patient's chest and rescuer's hands when little or no force is applied. This may be considered as the default behavior.

Additional stimuli may be applied to adjust the default behavior. For example, the additional stimuli may be used to increase stiffness in some cells and reduce stiffness in other cells at different times during the compression cycle. This may enable, for example, excessive compression depth to be avoided by softening the device once optimal compression depth is reached.

The shear thickening dynamics of the fluid may be designed and optimized for the range of forces present during CPR, for example, as described above with respect to different patient groups. Additionally, different devices may be designed with specific properties (size, stiffness etc.) tailored to different groups (e.g. children, adults or the elderly). For example, a pediatric CPR Device may be smaller than an adult device, and the cells for pixelated control proportionally smaller. The STF may be tuned such that it stiffens at a lower force, in line with that required to perform CPR on a child, compared with the STF used in an adult device. The maximum stiffness may also be lower than for an adult device, which may produce a balance between force transfer efficiency and patient comfort/injury reduction.

The adhesion control system 32 modifies the lateral forces being applied to the patient's skin and/or the user's skin. Modifying the lateral forces may control and reduce damage from friction effects, and/or control the puck position on the patient's chest using lateral forces delivered by a user either intentionally or during CPR compressions. The adhesion control system 32 may include materials with dynamically controllable friction and adhesion properties.

The friction (or otherwise, lateral force control) may be actively controlled in a pixilated manner, given available resolution of patient sensing and friction modulation systems. For example, sufficient friction to prevent puck slippage may be applied to skin areas which are not already damaged, while friction on areas of damages skin may be reduced. The position of the CPR device may be controlled by dynamically adjusting the adhesion properties in conjunction with the shape of the device such that the application of force during a compression cycle causes lateral movement of the CPR device in a controlled manner until the desired location is reached.

The system may include: an algorithm to determine the desired puck location given skin/bone condition and CPR effectiveness concerns, for example, this may be to move the puck 1 cm to avoid an area of damaged skin/bone; an algorithm to determine the friction/adhesion properties which should be applied to the surface pressed against the patient's skin, based on: patient skin condition, such as hydration, age, current damage state etc.; and forces being applied to the puck during the CPR compression cycle, which may be directly measured, or predicted using data from previous compression cycles; and desired puck location.

The shape control system 33 modifies the shape of the CPR Device. This may consist of multiple actuators across the CPR device that can be independently controlled to vary the thickness of the device in a pixelated manner. For example, an array of hydraulically amplified self-healing electrostatic (HASEL) actuators may be embedded in the device and covered with a flexible surface which may additionally be filled with an STF. Electrical activation of one actuator results in a change of thickness relative to neighboring actuators, resulting in the surface forming a slope between actuators. Using shape control, a perpendicular force applied to the device can thus be transformed to include a lateral component as well as perpendicular component of force applied to the patient's chest.

The patient monitoring apparatus 34 determines the condition of the patient. This includes monitoring of patient physiological parameters, and the patient's skin condition. Data from the patient monitoring apparatus is collected (the 'patient data'). A variety of sensors enables imminent injury to the patient's chest to be sensed or predicted and the system adjusts the force profile across the area of contact to reduce the risk of injury.

Patient physiological parameters relevant to CPR include but are not limited to: coronary perfusion pressure (CPP); delivery of blood to the brain; delivery of injected therapeutics around the body; detection and analysis of internal or external bleeding; and detection of subcutaneous soft tissue and bone damage.

These parameters may be measured by monitoring equipment internal or external to the CPR device. Monitoring equipment may include standard ultrasound imaging or UWB radar and a processing unit to image and analyze the heart muscle and adjacent vasculature, and measure blood pressures. That is, computational methods enable heart muscle and adjacent vasculature activity to be analyzed in real time using, for example, ultrasound and UWB radar, and blood pressure may also be measured using ultrasound. Additionally, bone damage, such as to the ribs, may be detected via changes to the pressure profile of pressure sensors on the CPR device. If the hemodynamic behavior is measured, then delivery of injected therapeutics around the circulatory system may be predicted. Unexpected changes in hemodynamic behavior and blood pressure may be indicative of bleeding. Knowledge of this can be used to adjust the force profile to minimize pressure on the blood vessels predicted to be bleeding.

The skin condition of the patient under the CPR device may be monitored in various ways using sensors in or connected to the device. Skin hydration may be monitored via capacitance measurement; oiliness and redness of the skin may be monitored via optical sensors; and elasticity of the skin may be monitored via vibrational sensors.

The CPR monitoring apparatus 35 monitors CPR activity. Data from the CPR monitoring apparatus is collected using various sensors (the 'CPR data'). These may include: compression rate, which may be determined, for example, by observing the change in acceleration over time, from an accelerometer, to determine the time taken to perform a compression cycle; compression depth, which may be determined, for example, by double integration of accelerometer data to determine the distance travelled between the top and bottom of a compression cycle; spatial and temporal profile of the force applied by the rescuer to the CPR device, which may be determined, for example, via pressure sensors on the rescuer (user) side of the device; and CPR device position. If a camera directed at the patient is available and accessible by the system, then the device position may be determined using image recognition techniques to determine the CPR device location on the patient's chest. Additionally, an array of pressure sensors on the underside (patient side) of the CPR device may be used to estimate the location of the device from the pressure profile. For example, higher pressure readings on the sensors are likely to indicate the bony structures such as the solar plexus and ribs, whereas lower reading are likely to indicate soft tissue such as the gaps between the ribs and the edge of the diaphragm.

The rescuer (user) monitoring apparatus 36 optionally monitors the state of the rescuer. The data is collected (the "rescuer data") and may include: skin condition of the hands in contact with the CPR device, which can be monitored in various ways using sensors on the rescuer side of the device, as discussed above (hydration, oiliness, redness, elasticity, etc.); and rescuer physiological parameters which may be used to determine a level of rescuer fatigue; and rescuer identification. The rescuer may change during CPR, which will change the optimum CPR device parameters that should be used. The change in rescuer may be recognized by the rescuer monitoring apparatus, for example, via changes in body geometry, or facial recognition if available.

The rescuer physiological parameters may include: heart rate, determined, for example, using pressure or optical sensors in contact with the rescuer's hand; breathing rate, which may indicate the level of exertion or calm of the user; body geometry and position, in particular arm positioning; and rescuer emotional state, which may be determined from a rescuer-facing camera, if available, and facial recognition, as discussed above. If a camera is available (for example, on an adjacent defibrillator (AED), in an ambulance or in a hospital room) then this may provide data on the rescuer state, such as breathing rate and discomfort in facial expressions, for example.

Monitoring the rescuer state may be important because if the rescuer's skin becomes too damaged or the rescuer becomes too fatigued, then the quality of CPR is likely to decline (or stop altogether). Therefore CPR device settings that facilitate the wellbeing of the rescuer, even at the cost of slightly lower CPR quality, may lead to better patient outcome overall. Examples of device settings to facilitate rescuer wellbeing include selective softening, and change in shape or points of adhesion in order to change the pressure profile on the rescuer's hand, or to encourage a different arm position.

Thus the system may increase rescuer comfort during delivery of CPR. The stiffness of the material on the rescuer side of the device may be adjusted in a pixelated fashion under the hands of the rescuer to maximize comfort and reduce the risk of repetitive pressure-related injury. The adhesion and frictional properties of the CPR device surface in contact with the rescuer's hands can be varied dynamically in a pixelated manner to reduce injury caused by rubbing. A variety of sensors enable rescuer comfort to be measured, and the system may adjust the force profile to increase comfort.

The CPR parameter design algorithm 37 designs tests to evaluate the effect of different sets of CPR device parameters on CPR quality. The mappings of CPR device parameters to CPR quality impacts are the 'CPR Device Profiles'. The effects on, for example, the patient's condition for an applied force range, of a set of device parameters are therefore determined and the effects are linked to the device parameters. The profile selection algorithm 38 selects a specific CPR device profile to achieve a specific goal in relation to the ongoing CPR (the 'goal'). The profile database 39 stores the CPR device profiles. These may be stored in accordance with the determined effects.

Thus, the controller may set the one or more variable properties of the device and then monitor the effects of the property settings on the patient and/or the user. The controller may store the property settings in a database, with the resultant effects. The controller may further monitor the condition of the patient, the user and/or the CPR delivery and determine a CPR goal. The controller may then compare the CPR goal with the effects of a plurality of device property settings stored in the database. The controller may set the property settings of the device to match settings stored in the database which achieve effects the same as, or similar to, the CPR goal.

Accordingly, patient damage resulting from CPR delivery may be reduced through the control of material properties, which vary the CPR compression force transfer dynamics based on measurements of patient tissue/bone condition and other CPR concerns. Damage may therefore be controlled or prevented through adjustment of the spatial and temporal dynamics of force application. It may be considered that the lateral (shear) forces and perpendicular forces of the device are controlled.

Figure 4:
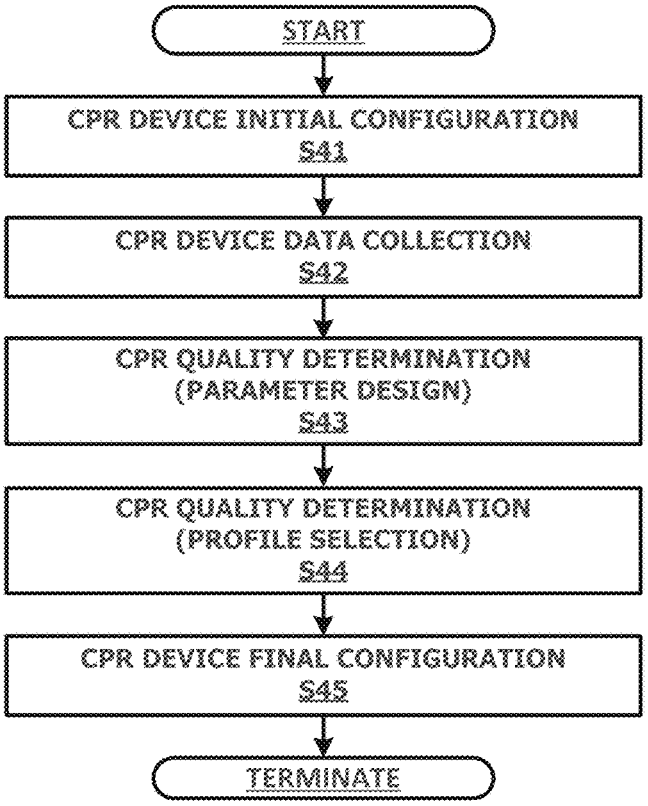
FIG. 4 is a flow chart of a control method for a CPR system according to an embodiment of an aspect of the invention.

The system may increase quality of CPR compressions. The depth of a compression may be controlled through the dynamic modification of force over the area of application on the patient chest during a CPR compression cycle, by reducing the stiffness of the material to reduce force on the chest once optimum compression depth is reached thus minimizing the risk of over compression. The quality of compressions may be increased by adjusting the distribution of force across the area covered by the device on both the patient side and rescuer side to direct delivery of force to the optimum location. The release of pressure during the upstroke of a compression cycle may be facilitated through the natural softening of the STF material once pressure is reduced. A variety of sensors may enable CPR quality to be measured, and the system may adjust the force profile to increase quality FIG. 4 shows a flow chart of a control method for a CPR system according to an embodiment of an aspect of the invention. At step S41, the CPR device is configured with an initial set of device parameters. The CPR device collects data as CPR is performed on the patient at step S42 and the CPR parameter design algorithm runs tests using different sets of CPR device parameters to determine their effect on CPR quality at step S43. At step S44, the profile selection algorithm runs tests using different sets of CPR device parameters to determine their effect on CPR quality and at step S45, the CPR device is configured with the selected device parameters.

The device parameters configure: the compression control system; the adhesion control system; and the shape control system. The CPR device collects data as CPR is performed. Data is collected from: the patient monitoring apparatus; the CPR monitoring apparatus; and the rescuer monitoring apparatus.

The CPR parameter design algorithm runs tests using different sets of CPR device parameters to determine their effect on CPR quality, and populates the profile database. The algorithm takes patient data, CPR data and optionally rescuer data as inputs and outputs sets of CPR device parameters and associated data on how the overall quality of CPR is affected under these parameters. These profiles are stored in the profile database. This process may be considered as the 'design procedure'.

An example implementation of the algorithm is described. When the design procedure is initiated, the CPR device is configured with an initial set of CPR device parameters. This may be for example the default state of the CPR device with no active control enabled. Device parameters may be time varying such that they change during the course of a compression cycle. This enables, for example, forces to be applied at changing angles and locations on the chest and thus onto the heart.

As compression cycles are performed, the algorithm receives patient data, CPR data and rescuer data under these parameter settings and provides scores ('profile scores') for each of the sets of data.

Example calculations for these scores include the following:

Hemodynamic score based on conditions compared to a predetermined ideal (e.g. determined by previous CPR studies), such as CPP achieved as a percentage of the ideal, or delivery of blood to the brain as a percentage of the ideal.

CPR Rate score: 1−|Current CPR Rate-Optimum CPR Rate|/Optimum CPR Rate

CPR Depth score: 1−|Current CPR Depth-Optimum CPR Depth|/Optimum CPR Depth

Patient skin impact score: for each controllable pixel of the device, the likely impact on the patient's skin underneath the pixel is estimated based on the friction/adhesion properties, and magnitude and direction of the applied force. This may be implemented as a lookup table based on data gathered from previous CPR sessions.

Rescuer skin impact score: for each controllable pixel of the device, the likely impact on the rescuer's skin underneath the pixel is estimated based on the friction/adhesion properties, and magnitude and direction of applied force. This may be implemented as a lookup table based on data gathered from previous CPR sessions.

These scores are stored along with the set of currently active CPR device parameters in the CPR device profile database. After a number of compression cycles the CPR device parameters are adjusted and the preceding two steps are repeated. The number of compression cycles between parameter adjustments may be fixed or based on when the scores are seen to stabilize, for example.

The adjustments may be predetermined to cycle through a representative range of shape, compression and adhesion/friction settings, or may be dynamically determined based on a prediction of what is likely to improve CPR performance. For example, if the left ventricle (LV) of the patient's heart is observed to be inadequately compressed, changes to the location, shape and compression characteristics of the CPR device predicted to increase compression of the left ventricle are selected. This prediction may be derived from previously run tests, or a set of rules derived from previous CPR studies. For example, if the maximum force is not currently applied directly above the LV, the shape/location of the device may be changed such that the maximum force is directly above the LV. Changing the parameters may also lead to a change of the CPR device location. Device location data is stored as part of the CPR device profiles.

Once a number of sets of CPR device parameters have been tested, the design procedure ends. The number of sets may be predetermined to provide a representative range of shape, compression and adhesion/friction settings, or may end once a particular set of scores is achieved, or after a fixed amount of time.

Conditions that may trigger the Design Procedure to run, or re-run, include:

when CPR is started, which may be determined from CPR Data;

when the rescuer changes, which may be determined from rescuer data, and if data related to the new rescuer is not already available in the profile database;

if the CPR device is moved and no profile data is available at the new location;

if the measured patient, CPR and rescuer data under a given set of CPR device parameters deviates significantly from that expected from the profile data—this may indicate some underlying change, such as, for example, a loosening of the patient chest over time, a rib fracture or new bleeding; and after a predefined amount of time.

The profile selection algorithm selects a set of CPR device parameters to achieve a defined goal. The algorithm takes CPR profile data, patient data, CPR data and rescuer data as inputs, and outputs a selected set of CPR device parameters which are used to configure the CPR device. Goals may include:

maximizing brain blood flow or CPP above all else;

achieving adequate brain blood flow or CPP while minimizing injury to the patient and the rescuer; achieving delivery of injected therapeutics around the body; and achieving optimum hemodynamics taking into account detected bleeding.

Goal selection may be predetermined and selected at the start of CPR, or changed during CPR. A primary goal is selected and optionally secondary goals are selected that become active if the primary goal is achieved. Goal selection examples may include: if the patient is in a controlled environment with multiple available rescuers, such as a hospital, goal (i) may be selected; if the patient is outside the hospital, a single rescuer is available and arrival time of additional help is unknown, then goal (ii) may be preferred to maximize the chance of the rescuer continuing with CPR; and if therapeutics are injected into the patient, then goal (iii) may temporarily preferred.

An example implementation of the algorithm is provided. Firstly, the available data is evaluated to determine: hemodynamic score; patient skin condition; optionally, rescuer skin condition; and optionally, rescuer fatigue state. Based on the selected goal and the calculated scores above, the profile that is expected to best achieve the goal is then selected. If skin damage is included in the goals then the effect of a profile on the skin can be predicted from the current measured skin condition and the skin impact score of the profile. This may be implemented as a look up table based on observations from previous CPR sessions. Finally, the data is re-evaluated regularly and the profile selection is changed as required.

The CPR device is configured with the selected device parameters.

Figure 5:
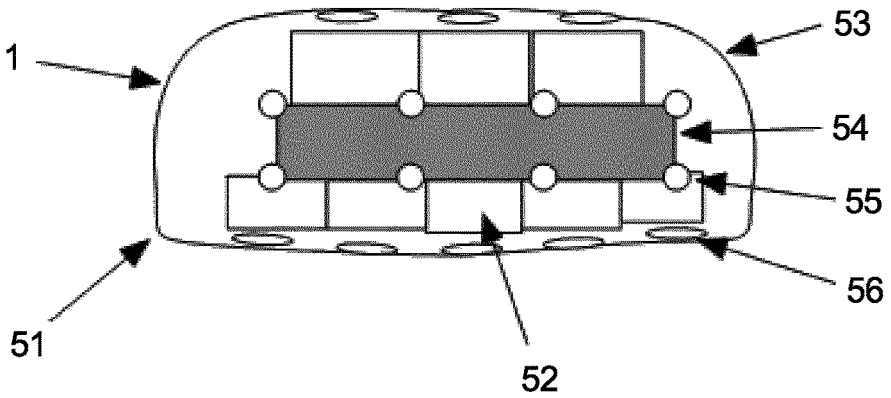
FIG. 5 is a schematic diagram of a CPR device according to an embodiment of the invention.

FIG. 5 shows is a schematic diagram of a CPR device according to an embodiment of the invention. The CPR device 1 comprises: a surface with adjustable friction/adhesion properties 51; an array of shape-changing actuators 52; tunable shear-thickening material 53; power and control system 54; sonic actuators 55; and sensors 56.

The array of shape-changing actuators 53 allow for pixelated control of the shape of the device 1 and may, for example, be HASELs. The sensors 56 may be, for example, pressure, optical, capacitive, acceleration, etc. sensors. The sonic actuators 55 may be ultrasonic actuators and may be operated to apply an oscillatory or mechanical stimulus to the tunable shear-thickening material 53 to alter its viscosity.

Figure 6:
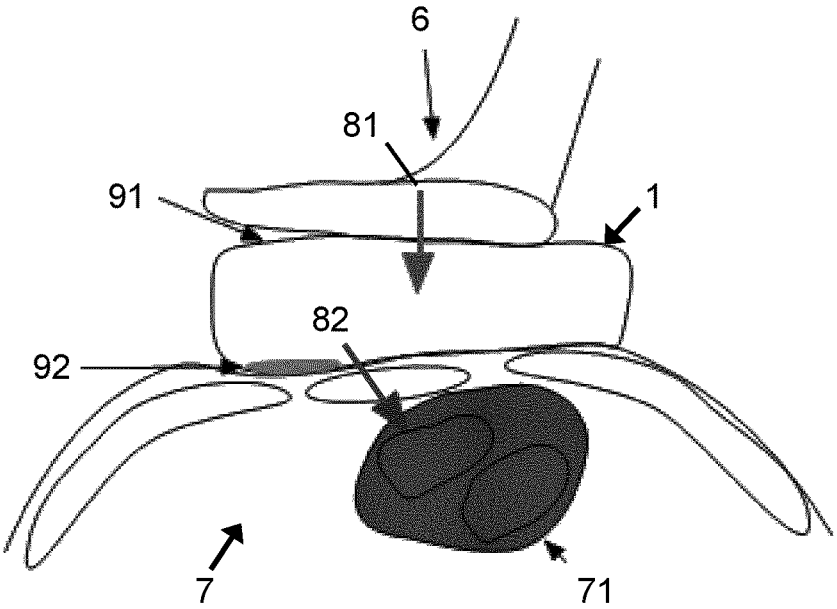
FIG. 6 is a schematic diagram of a CPR device in use during the delivery of CPR to a patient by a user according to an embodiment of the invention.

FIG. 6 shows a schematic diagram of a CPR device in use during the delivery of CPR to a patient by a user according to an embodiment of the invention. The diagram shows a user's hand 6 applying a chest compression to the patient's chest 7, with the device 1 disposed between the user's hands 6 and the patient 7. The device is positioned on the chest of the patient 7 above the patient's heart 71. The force of the compression 81 is input to the device 1 and the device outputs a force output 82 to the patient 7.

The properties of the CPR device 1 may be adjusted so that the CPR device 1 conforms to the patient's chest 7 and the user's hands 6. The shape and other properties of the device 1 are adjusted as shown at point 91. For example, adhesion at point 92 facilitates force transfer at an angle.

Figure 7:
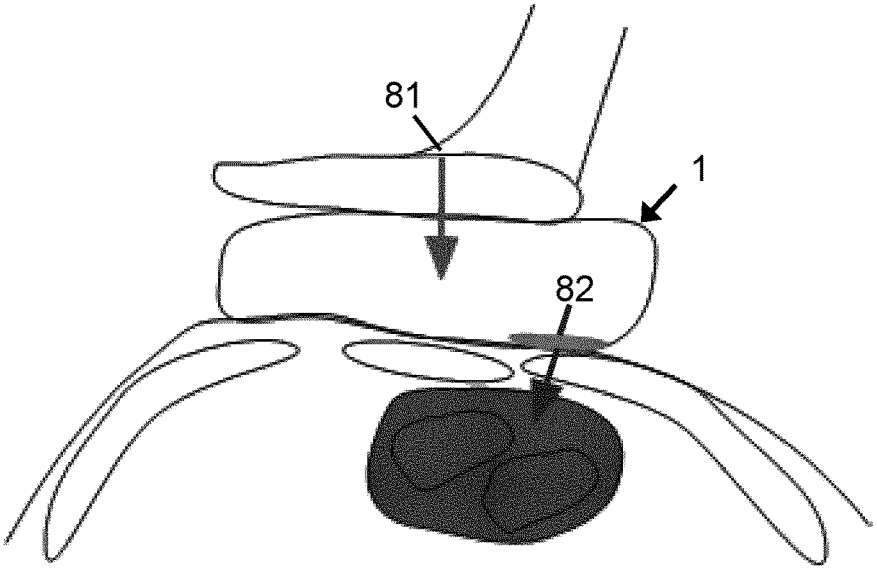
FIG. 7 is a schematic diagram of a CPR device in use during the delivery of CPR to a patient by a user according to an embodiment of the invention.

FIG. 7 shows is a schematic diagram of a CPR device in use during the delivery of CPR to a patient by a user according to an embodiment of the invention. In comparison to FIG. 6, it can be seen that the properties of the device 1 have been adjusted so that the shape and position of the device 1 are different. Hemodynamic differences in response to different puck properties are measured and the properties of the device (puck) 1 may be varied accordingly.

As may be seen from the above, embodiments of the present invention may provide a CPR device, a control method and a computer program. The CPR device may comprise one or more variable properties that may be altered so as to regulate a profile of the CPR device. The CPR device may be provided as part of a CPR system. Embodiments of the present invention may overcome disadvantages of the prior art discussed above.

CPR qualities such as hemodynamic activity within a patient may be optimized for a given CPR performance of a rescuer. This may be achieved by adjusting properties of a CPR device including shape, stiffness and adhesion/friction through the use of materials and actuators that enable these properties to be adjusted dynamically. This may be coupled with techniques to monitor the CPR effectiveness on the patient to enable selection of the device properties for optimal outcome.

Embodiments of aspects of the present invention may provide optimized hemodynamic activity in a cardiac arrest patient for a given rescuer CPR performance, by adjusting the force profile applied to the chest of the patient through adjustment of one or more properties of a CPR device.

Embodiments of aspects of the present invention may provide a reduction in injury to the patient due to CPR by spatial and temporal adjustment of the perpendicular and lateral forces applied to the chest of the patient by a CPR device to minimize frictional skin damage and pressure-related damage to subcutaneous soft tissue and bone (caused by, for example, over compression).

Embodiments of aspects of the present invention may provide a reduction in injury and increased comfort for the rescuer by spatial and temporal adjustment of the perpendicular and lateral forces experienced on the hands of the rescuer from a CPR device to minimize frictional skin damage, pressure related and repetitive strain related damage.

Although only a few exemplary embodiments have been described in detail above, those skilled in the art will readily appreciate that many modifications are possible in the exemplary embodiments without materially departing from the novel teachings and advantages of the embodiments of the present disclosure. The above-described embodiments of the present invention may advantageously be used independently of any other of the embodiments or in any feasible combination with one or more others of the embodiments.

Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

In addition, any reference signs placed in parentheses in one or more claims shall not be construed as limiting the claims. The word "comprising" and "comprises," and the like, does not exclude the presence of elements or steps other than those listed in any claim or the specification as a whole. The singular reference of an element does not exclude the plural references of such elements and vice-versa. One or more of the embodiments may be implemented by means of hardware comprising several distinct elements. In a device or apparatus claim enumerating several means, several of these means may be embodied by one and the same item of hardware. The mere fact that certain measures are recited in mutually different dependent claims does not indicate that a combination of these measures cannot be used to an advantage.

The invention claimed is:

1. A cardiopulmonary resuscitation (CPR) device for enhancing a delivery of CPR to a patient, the CPR device comprising:

a patient side for engagement with a chest of the patient; and a user side for engagement with at least one hand of a user delivering CPR to the patient, wherein one or more of a surface of the patient side and a surface of the user side is at least partially formed of a material with variable contact characteristics configured to be controlled during the delivery of the CPR to the patient so as to regulate a lateral force distribution profile at the one or more of the surface of the patient side and the surface of the user side from a force applied to the CPR device by the user and transferred through the CPR device to the patient during the delivery of the CPR to the patient.

2. The CPR device of claim 1, further comprising:

a controller configured to control the variable contact characteristics of the material during the delivery of the CPR to the patient so as to provide the target lateral force distribution profile at the one or more of the surface of the patient side and the surface of the user side from a force applied to the device by the user.

3. The CPR device of claim 2, further comprising:

a force sensor configured to acquire force sensor data of a force applied to the device, wherein the controller is further configured to determine the target lateral force distribution profile in accordance with the force sensor data.

4. The CPR device of claim 2, wherein the CPR device is communicably coupled with a patient sensor configured to collect patient sensor data relating to a condition of the patient;

wherein the CPR device is configured to receive the patient sensor data from the patient sensor; and wherein the controller is further configured to determine the target lateral force distribution profile in accordance with the patient sensor data.

5. The CPR device of claim 2, wherein the CPR device is communicably coupled with a user sensor configured to collect user sensor data relating to a condition of the user;

wherein the CPR device is configured to receive the user sensor data from the user sensor; and wherein the controller is further configured to determine the target lateral force distribution profile in accordance with the user sensor data.

6. The CPR device of claim 2, wherein the CPR device is communicably coupled with a memory;

wherein the CPR device is configured to acquire information on the patient from the memory; and wherein the controller is further configured to determine the target lateral force distribution profile in accordance with the information on the patient.

7. The CPR device of claim 2, wherein the CPR device is communicably coupled with a memory;

wherein the CPR device is configured to acquire information on the user from the memory; and wherein the controller is further configured to determine the target lateral force distribution profile in accordance with the information on the user.

8. The CPR device of claim 2, wherein the one or more of the surface of the patient side and the surface of the user side formed of the material with variable contact characteristics is segregated into a plurality of material sections; and wherein the controller is further configured to control the variable contact characteristics of the material of a material section of the plurality of material sections independently of one or more of the other material sections of the plurality of material sections.

9. The CPR device of claim 2, wherein the controller is configured to control the variable contact characteristics of the material using one or more of:

electro-adhesion;

ultrasound; and surface design.

10. The CPR device of claim 2, wherein the CPR device is communicably coupled with a camera configured to acquire image data of the CPR device positioned on a chest of the patient;

wherein the CPR device is configured to receive the image data from the camera; and wherein the controller is further configured to determine the position of the CPR device relative to the chest of the patient and to determine the target lateral force distribution profile in accordance with the position of the CPR device relative to the chest of the patient.

11. The CPR device of claim 2, further comprising a plurality of pressure sensors disposed on the patient side of the CPR device and each configured to acquire pressure sensor data of pressure applied to the CPR device, wherein the controller is further configured to determine a position of the CPR device relative to the chest of the patient using the acquired pressure sensor data and to determine the target lateral force distribution profile in accordance with the position of the CPR device relative to the chest of the patient.

12. The CPR device of claim 1, wherein the contact characteristics are one or more of friction and adhesion.

13. The CPR device of claim 1, wherein the one or more of the surface of the patient side and the surface of the user side formed of the material with variable contact characteristics is segregated into a plurality of material sections; and wherein the material of a material section of the plurality of material sections is different to the material of one or more of the other material sections of the plurality of material sections.

14. A control method for a cardiopulmonary resuscitation (CPR) device for enhancing a delivery of CPR to a patient, the CPR device comprising a patient side for engagement with a chest of the patient and a user side for engagement with at least one hand of a user delivering CPR to the patient, wherein one or more of a surface of the patient side and a surface of the user side is at least partially formed of material with variable contact characteristics configured to be controlled during the delivery of the CPR to the patient so as to regulate a lateral force distribution profile at the one or more of the surface of the patient side and the surface of the user side from a force applied to the CPR device by the user and transferred through the CPR device to the patient during the delivery of the CPR to the patient, the method comprising:

acquiring one or more of the following data types:

force data of a force applied to the CPR device;

patient sensor data relating to a condition of the patient;

user sensor data relating to a condition of the user;

information on the patient;

information on the user;

image data of the CPR device positioned on the chest of the patient; and pressure sensor data of pressure applied to the CPR device; and controlling the variable contact characteristics of the material during the delivery of the CPR to the patient so as to provide a target lateral force distribution profile at the one or more of the surface of the patient side and the surface of the user side from a force applied to the CPR device by the user in accordance with one or more of the acquired data types.

15. A computer program which, when executed on a computing device, carries out a control method for a cardiopulmonary resuscitation (CPR) device for enhancing a delivery of CPR to a patient, the CPR device comprising a patient side for engagement with a chest of the patient and a user side for engagement with at least one hand of a user delivering CPR to the patient, wherein one or more of a surface of the patient side and a surface of the user side is at least partially formed of material with variable contact characteristics configured to be controlled during the delivery of the CPR to the patient so as to regulate a lateral force distribution profile at the one or more of the surface of the patient side and the surface of the user side from a force applied to the CPR device by the user and transferred through the CPR device to the patient during the delivery of the CPR to the patient, the computer program comprising program code to:

acquire one or more of the following data types:

force data of a force applied to the CPR device;

patient sensor data relating to a condition of the patient;

user sensor data relating to a condition of the user;

information on the patient;
information on the user;
image data of the CPR device positioned on the chest of the patient; and
pressure sensor data of pressure applied to the CPR device; and control the variable contact characteristics of the material during the delivery of the CPR to the patient so as to provide a target lateral force distribution profile at the one or more of the surface of the patient side and the surface of the user side from a force applied to the CPR device by the user in accordance with one or more of the acquired data types.

* * * * *